US007361239B2

(12) United States Patent
Zahrah et al.

(10) Patent No.: US 7,361,239 B2
(45) Date of Patent: Apr. 22, 2008

(54) HIGH-DENSITY METALLIC-GLASS-ALLOYS, THEIR COMPOSITE DERIVATIVES AND METHODS FOR MAKING THE SAME

(75) Inventors: Tony F. Zahrah, Fairfax, VA (US); Roderick Rowland, Fairfax, VA (US); Laszlo Kecskes, Havre de Grace, MD (US)

(73) Assignee: Matsys, Inc., Sterling, VA (US)

( * ) Notice: Subject to any disclaimer, the term of this patent is extended or adjusted under 35 U.S.C. 154(b) by 482 days.

(21) Appl. No.: 10/946,132

(22) Filed: Sep. 22, 2004

(65) Prior Publication Data

US 2006/0062684 A1 Mar. 23, 2006

(51) Int. Cl.
*C22C 45/10* (2006.01)
*C22C 27/04* (2006.01)

(52) U.S. Cl. ..... 148/561; 148/673; 148/423; 75/248

(58) Field of Classification Search ..... 75/245, 75/246, 248
See application file for complete search history.

(56) References Cited

U.S. PATENT DOCUMENTS

| | | | | |
|---|---|---|---|---|
| 5,288,344 | A | 2/1994 | Peker et al. | |
| 5,618,359 | A | 4/1997 | Lin et al. | |
| 5,735,975 | A | 4/1998 | Lin et al. | |
| 5,740,854 | A | 4/1998 | Inoue et al. | |
| 5,797,443 | A | 8/1998 | Lin et al. | |
| 6,427,753 | B1 | 8/2002 | Inoue et al. | |
| 6,592,689 | B2 | 7/2003 | Hays | |
| 6,692,590 | B2 | 2/2004 | Xing et al. | |
| 6,918,973 | B2 | 7/2005 | Hufnagel et al. | |
| 7,163,205 | B1 * | 1/2007 | Kecskes et al. | 273/410 |
| 2005/0084407 | A1 * | 4/2005 | Myrick | 419/66 |
| 2005/0121117 | A1 | 6/2005 | Hufnagel et al. | |
| 2006/0130943 | A1 * | 6/2006 | Peker | 148/561 |

OTHER PUBLICATIONS

Magness, L., An Overview of the Penetration Performances of Tungsten and Depleted Uranium Alloy Penetrators: Ballistic Performances and Metallographic Examinations, 20th Int'l. Symposium on Ballistics, Orlando, FL, Sep. 23-27, 2002, pp. 1-8.
Biancaniello, et al., Characterization of Nanostructured Tungsten Heavy Alloy Produced by Double Ball Milling; 4th Int'l. Conference on Tungsten Refractory Metals and Alloys: Processing, Properties and Applications, 1997, pp. 213-218.
Hui, et al., Preparation, microstructure and mechanical properties of Zr-based bulk amorphous alloys containing tungsten, Intermetallics, vol. 10, Issues 11-12, Nov. 2002, pp. 1065-1069.

(Continued)

*Primary Examiner*—George Wyszomierski
(74) *Attorney, Agent, or Firm*—Wiley Rein, LLP

(57) ABSTRACT

The invention includes a method for producing high-density composites of metallic glass alloy powders in combination with a refractory metal powder, and includes related methods for producing metallic glass alloys. The invention, in one aspect, employs a system of monitoring the temperature and hot isostatic pressing conditions during the consolidation of metallic compositions in order to produce higher densities and materials of a larger diameter, for example. In another aspect, the invention involves method whereby a third interfacial phase at a metallic glass alloy/refractory metal interface is effectively controlled to produce composites with advantageous properties.

42 Claims, 11 Drawing Sheets

OTHER PUBLICATIONS

DeLo, et al., Early stage consolidation mechanisms during hot isostatic pressing of Ti-6Al-4V powder compacts, Acta Materialia, vol. 47, Issue 9, Jul. 9, 1999, pp. 2841-2852.

Alberta, et al., Piezoelectric and dielectric properties of transparet Pb(Ni Nb ) Zr Ti O ceramics prepared by hot isostatic pressing, Int'l Journal of Inorganic Materials, vol. 3, Issue 7, Nov. 2001, pp. 987-995.

Quick-HIP: Rapid Isostatic Press, "Pressing the State of the Art," Institute of Materials Processing, Michigan Technological University, 2000.

Gu, X, et al., "Glass-forming ability and crystallization of bulk metallic glass (HfxZr1-x) 52.5 Cu17.9Ni14.6Al10Ti5", J. Non-Cryst. Sol., 311(1):77-82,2002.

Johnson, W.L., "Bulk Glass-forming metallic alloys: science and technology", MRS Bullentin, 24(10):42-56, 1999.

Peker, A., et al., "A highly processable metallic glass: Zr41.2Ti138.8Cu12.5Ni10.0Be22.5", Appl. Phys. Lett. 63(17)2342-2344, 1993.

Spaepen, F., et al., "A microscopic mechanism for steady state inhomogeneous flow in metallic glasses", Acta. Met., 25(4):407-414,1997.

Subhash, et al., "Characterization of unaxial compression response of bulk amorphous Zr-Ti-Cu-Ni-Be alloy", Mat. Sci. and Eng., A334(1):33-40, 2002.

Xing, L.Q., et al., "Alloys of high glass-forming ability", J. Non-Crystalline Solids, 205-207(2):597-601, 1996.

* cited by examiner

HIGH-DENSITY METALLIC-GLASS-ALLOYS, THEIR COMPOSITE DERIVATIVES AND METHODS FOR MAKING THE SAME

U.S. GOVERNMENT INTEREST

This invention was made in part with Government support under contract W911QX-04-P-0271 awarded by the U.S. Army Research Laboratory, and contract N00014-03-C-0287 awarded by the Office of Naval Research. The Government may have certain rights in the invention.

FIELD OF THE INVENTION

The present invention relates generally to metallic glass alloys (MGAs), refractory metal reinforced MGA matrix composites, more particularly those made from a combination of a MGA powder and tungsten powders, and to methods of making these alloys and compositions. A particular advantage of the invention is the high density of the alloys and composites, on the order of 17 g/cm$^3$ or higher for certain tungsten composites.

DESCRIPTION OF PRIOR ART

Metallic Glass Alloys (MGAs), or bulk metallic glasses, are amorphous metals and have been reported as existing in thin ribbon form since as early as the 1950s. Metallic glasses differ from conventional metals in that they lack crystalline structure. The atoms in the amorphous structure are randomly arranged, like in a liquid, rather than sitting on a repeatable, orderly lattice. This lack of crystalline structure means that metallic glasses also lack crystalline defects, such as grain boundaries and dislocations. Without these defects metallic glasses exhibit extraordinary mechanical properties, magnetic behavior, and corrosion resistance.

Because the equilibrium structure for a metal alloy is always crystalline, amorphous metals can only be produced by avoiding the equilibrium state, such as by rapid cooling from the liquid state. Until recently, the cooling rates required were on the order of $10^5$-$10^6$ K/s. In order to cool at such a rate, the thickness of the metal alloy becomes an important factor and, in effect, the cooling rate limits the thickness of a fully amorphous alloy to fractions of a millimeter. The resulting ribbons and wires are used extensively as transformer cores and magnetic sensors, but the small dimensions limit the structural applications of the material.

MGAs can be generally represented by the formula $X_aCu_bNi_cAl_dY_e$, wherein X includes at least one transition metal element selected from periodic table Group IV; Y includes at least one element selected from Group IV transition metal elements, wherein X is not equal to Y, Group VA, VIII, IVB, and VB; wherein a+b+c+d+e=100% (atomic percent); and a is less than 60, preferably 35<a<45, 15<b<35, 5<c<25, 0<d<20, 0<e<15, and 0<f<15. Exemplary alloys in this composition range can be formed into an amorphous, glassy structure at moderate cooling rates of about 1,000 K/s.

The development of zirconium (Zr)-based MGAs has opened the door for use of these fascinating materials in structural applications. These alloys require cooling rates of only 1-100 K/s, so fully amorphous castings up to a centimeter thick can be manufactured using conventional casting methods. MGAs are already used in golf clubs, tennis rackets, baseball bats, fishing rods, car bumpers, aircraft skins, artificial joints, dies, armor-piercing projectiles, engine parts, and cutting tools. Generally, these alloys are found at or near deep eutectics, have high viscosity in the melt, and contain three or more constituents. A small element atom and a large element atom are frequently added to further slow down the kinetics and thus allow the high viscosity liquid to freeze without crystallization occurring. In general, these MGA alloys can only be cast in ingots a few centimeters or less in diameter.

The most common Zr-based MGAs have densities of about 7 g/cm$^3$. However, recent developments related to iron (Fe)— and hafnium (Hf)-based MGAs have improved on these densities by at least 20 to 70%, without a loss in relative glass forming ability, i.e., the ability to cast large or thick sections.

Thus, there is a desire in the art for high density MGAs and composites as well as processes for producing high density alloys and composites of a larger diameter or size than currently available. In one aspect, this invention addresses this desire by providing methods to produce MGAs and metallic glass compositions of high density and producing MGAs and/or metallic glass composites of a relatively large diameter.

BRIEF SUMMARY OF THE INVENTION

The present invention provides a practical, readily scaleable, and easily realizable processing route for the fabrication of monolithic and composites derived from metallic glass alloys (MGAs) and composite derivatives thereof.

One embodiment of the invention is new, high density MGA or composite, generally represented by a multi-element formula, wherein at least one component is selected from periodic table Group IVA, at least one other element is selected from Groups VA, VIII, IVB, and VB. The elements can be metals, metalloids, or non-metallic in nature. The total number of elements can vary from about four, five, or six to as many as ten or more. Exemplary alloys of this type can be formed into an amorphous, bulk glassy structure at moderate cooling rates of less than 1,000 K/s. Exemplary alloys of this type can also be formed into an amorphous, glassy, finely divided particulate matter or powder by any form of inert-gas atomization. In one aspect, the formula for the alloys or composites can be $X_aCu_bNi_cAl_dY_e$, wherein X includes at least one transition metal element selected from periodic table Group IV; Y includes at least one element selected from Group IV transition metal elements, wherein X is not equal to Y, Group VA, VIII, IVB, and VB; wherein a+b+c+d+e=100% (atomic percent); and a is less than 60, preferably 35<a<45, 15<b<35, 5<c<25, 0<d<20, 0<e<15, and 0<f<15.

One aspect of the disclosure, among others, provides exemplary glass metallic alloys having a density greater than about 7 g/cm$^3$.

Another aspect provides representative alloys which have one or more characteristic features of known metallic glasses, including: a distinct glass transition; a supercooled liquid region; and a devitrification sequence that results in the loss of the disordered structure.

Proper control of the devitrification sequence may result in features that consist of uniformly dispersed nanoscale-sized crystallites in a mostly glassy matrix to a bulk solid structure that is fully crystalline. This is equivalent to a structural composite having medium to long range order.

In another aspect, the invention relates to methods employing Hot Isostatic Pressing (HIP) in conjunction with the use of a highly sensitive analysis of the reaction conditions, such as using a High Temperature Eddy Current Sensor (HiTECS) system. Using the methods of the invention, the consolidation of the monolithic or composite material is monitored and controlled in real time and optionally with an exact precision and adaptive flexibility as desired to produce resulting alloys and composites.

In another aspect, the invention involves the exploitation of the densification behavior of the MGA and MGA derivative composite materials. Particularly, the monolithic MGA material densifies in a step-wise, abrupt manner as determined by the temperature and time at temperature cycles. The MGA densification occurs rapidly in an almost instantaneous response to a change in processing temperature. In contrast to the typical behavior of crystalline materials, this behavior is attributed to the amorphous nature of the MGA material. Therefore, the composite material, derived from the combination of a refractory metal (in one example tungsten) and an MGA powder, exhibits a densification behavior that is a superposition of both amorphous and crystalline components, each responding to their own temperature sensitivity.

The invention also relates to the dimensional properties and the relative ease of how the resultant materials may be obtained from the instrumented HIP procedures. In one particularly advantageous aspect, using the processing route and methods of the invention, there is no limit to the size of structural parts that could be made. Moreover, both monolithic MGA and MGA-tungsten composite materials exhibit an excellent consolidation response on a large scale, reaching full density with little or a minimum interference or number of required process steps to control the phase structures present.

Another aspect of the invention relates to the physical and chemical properties of the resultant materials. A precise control of the temperature, time, and pressure during the consolidation results in little or no devitrification of the MGA structure. Conversely, careful adjustment of these variables, especially time and temperature, enable and facilitate the development of fine-scale substructure ranging from nano- to micrometer sized features that result in an active, intentional modification of material properties. For instance, on the one hand, a judicious selection of the MGA powder chemistry to make use of its compatibility with that of tungsten can lead to the formation of desirable intermetallic phases that, in turn, lead to improved properties, such as improved interfacial bonding, increased fracture toughness, or greater ductility. On the other hand, the same parameters can optionally be selected in order to lead to the controlled failure along the interface once a certain threshold stress level is exceeded.

In one general aspect of the invention, a method of forming a metallic glass composite is provided, wherein a mixture of metallic glass alloy powder and refractory metal powder is heated in a closed chamber for a period of time. The metallic glass alloy powder comprises 10 to 50 vol % of the mixture and the refractory metal powder comprises 50 to 90 vol % of the mixture. The temperature inside the chamber is raised to a first temperature less than the glass transition temperature ($T_g$) of the metallic glass alloy powder, and the period of time, the temperature, and the pressure inside the chamber selected promote consolidation. The chamber is further heated to a second temperature for a second period of time and the mixture pressed (put under pressure), wherein the second temperature is greater than the single crystallization event temperature ($T_x$) of the metallic glass alloy powder and less than about 50° C. above the liquidus temperature of the metallic glass alloy powder, and wherein the pressing of said mixture can be used to form a resultant material of a desired shape and size. Then, immediately cooling the mixture once the second temperature is reached to obtain a metallic glass composite. Advantageously, the formation of a third phase along the metallic glass alloy/refractory metal interface is controlled and a highly dense, large diameter material is produced. Optionally, the heating to a first temperature noted in the method above and the methods throughout this invention disclosure can be omitted so that the heating to a second temperature becomes the primary or initial heating step.

Using the above general method, a range of desired composites can be prepared depending on the selection of metallic glass alloy powder, the metal, and the conditions used. In a preferred embodiment, a Hf-based metallic glass alloy powder is selected. In another preferred embodiment, the refractory metal powder is tungsten powder. The selection of the vol % of metallic glass alloy powder and refractory metal powder can dictate the density of the resulting composite. Thus, for example, selecting appropriate vol % of Hf-based metallic glass alloy powder and tungsten powder can generate resulting high density composites of between about 16.0 to about 16.9, from about 16.9 to about 17.2, from about 17.2 to about 17.9, from about 17.9 to about 18.5 g/cm$^3$. These resulting composites can be produced with large diameters, from about 10 mm to about 50 mm or greater and any desired range from about 10 to about 20, about 30 to about 40, or about 40 to about 50 mm in diameter.

In other preferred embodiments, an Fe-based metallic glass powder can be selected, or Zr—, Ti—, or Mg-based alloy. Specific examples can employ at least one of the following metallic glass alloys as the powder: $Hf_{44.5}Ti_5Cu_{27}Ni_{13.5}Al_{10}$ or $Fe_{58.3}B_{16}Cr_{14.6}C_4Mn_2Mo_2W_2Si$.

In another aspect, the invention provides a method of forming a metallic glass alloy comprising heating a metallic glass alloy powder to a first temperature less than the glass transition temperature ($T_g$) of the metallic glass alloy; hot pressing said alloy at the first temperature in a closed chamber at a pressure of about 15 Ksi (103 MPa) or above; further heating and pressing the alloy to a second temperature greater than the glass transition temperature ($T_g$) of the metallic glass alloy but less than the single crystallization event temperature ($T_x$) of the metallic glass alloy powder; and immediately cooling the alloy once the second temperature is reached to obtain a metallic glass alloy. Advantageously, a substantial degree of the initial amorphous properties of the metallic glass alloy powder are retained to result in a highly dense alloy with excellent structural properties. The method can also be used to press the alloy into a desired shape and size. As above, the metallic glass alloy powder can be selected from the Hf-based metallic glass alloys, such as $Hf_{44.5}Ti_5Cu_{27}Ni_{13.5}Al_{10}$, or other alloys can be used. Also as noted above, the selection of the metallic glass alloy can generate resulting high density MGAs of between about 10.0 to about 10.9 g/cm$^3$ in the case of Hf-based alloys, such as $Hf_{44.5}Ti_5Cu_{27}Ni_{13.5}Al_{10}$. These resulting composites can also be produced with large diameters, from about 10 mm to about 50 mm or greater and any desired range from about 10 to about 20, about 30 to about 40, or about 40 to about 50 mm in diameter.

In another aspect, the invention provides a method of forming a metallic glass alloy comprising heating a metallic glass alloy powder to a first temperature less than or equal to the single crystallization event temperature ($T_x$) of the metallic glass alloy powder; hot pressing the alloy at the first temperature in a closed chamber under a pressure of about 15 Ksi (103 MPa) or above; further heating and pressing the alloy to a second temperature greater than the single crystallization event temperature ($T_x$) of the metallic glass alloy powder; and immediately cooling the alloy once the second temperature is reached to obtain a metallic glass alloy. Advantageously, the resulting alloy retains a substantial degree of the initial amorphous properties of the metallic glass alloy powder and a highly dense alloy is generated. The method can also be used to press the alloy into a desired shape and size. As above, the metallic glass alloy powder can be selected from the Fe-based metallic glass alloys, such as $Fe_{58.3}B_{16}Cr_{14.6}C_4Mn_2Mo_2W_2Si$, or other alloys can be used. Also as noted above, the selection of the metallic glass alloy can generate resulting high density MGAs of between about 7.0 to about 7.3 g/cm$^3$ in the case of the Fe-based alloys, such as $Fe_{58.3}B_{16}Cr_{14.6}C_4Mn_2Mo_2W_2Si_1$. These resulting composites can also be produced with large diameters, from about 10 mm to about 50 mm or greater and any desired range from about 10 to about 20, about 30 to about 40, or about 40 to about 50 mm in diameter.

In another aspect, the invention specifically includes a monolithic bulk metallic glass alloy of a particular size and shape. For example, any of the above-noted methods can be used to prepare a cylindrical material, where the cylinder has a diameter from about 20 to about 30 mm, or about 30 to about 40 mm, or about 40 to about 50 mm, or greater than about 50 mm. In addition, the invention includes structural composites produced from the methods described, wherein the average particle size of the tungsten powder is at least twice the average particle size of the amorphous metal powder used. The structural composites can also be characterized by the tungsten powder as having a submicron average particle size, by the tungsten powder having an average particle size of about 5 mm, by the tungsten powder having an average particle size of about 10 to 15 mm, by the tungsten powder having an average particle size of about 15 to 50 mm, by the MGA powder having a submicron average particle size, by the MGA powder having an average particle size of about 5 mm, by the MGA powder having an average particle size of about 5 to 15 mm, or by the MGA powder having an average particle size of about 25 to 45 mm.

As noted above, the system for monitoring the consolidation of the composites or alloys during the heating processes or during a hot isostatic pressing process can comprise one or more probes. The HiTECS system is a preferred system. Other systems can be employed and others are known in the art. For this and other general metal powder handling techniques, the selection of metals, alloys, and temperatures, and the resulting properties and their analyses, see "ASM Handbook Volume 7: Powder Metal Technologies and Applications," editors W. B. Eisen et al., ASM International, which is specifically incorporated herein by reference in its entirety.

In another aspect, the invention comprises controlling a third interfacial phase when preparing a structural composite, or MGA composite, or amorphous solid as described herein. As used in this disclosure, "third interfacial phase," "third crystalline phase," and "third interlayer phase" refer to the same phase, area, or phenomenon. In one embodiment of this aspect, the thickness of an additional phase along the MGA/refractory metal interface is controlled, such as by monitoring on or more of the following factors: the temperature; the time at temperature; the maximum temperature; and/or the cooling. For example, in the methods employing hafnium or hafnium-based metals, the thickness of the third interfacial phase can be minimized by controlling one or more of the factors. Also, in the methods employing iron or iron-based metals, the thickness of the third interfacial phase can be maximized by controlling one or more of the factors. Similarly and more generally, minimizing or maximizing the thickness or extent of the third interfacial phase can be achieved in many other combinations and methods by controlling one or more of the factors noted above. Thus, this controlling the interfacial phase aspect can be introduced into any of the methods described herein.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention.

DETAILED DESCRIPTION OF EXEMPLARY EMBODIMENTS

Figure 1:
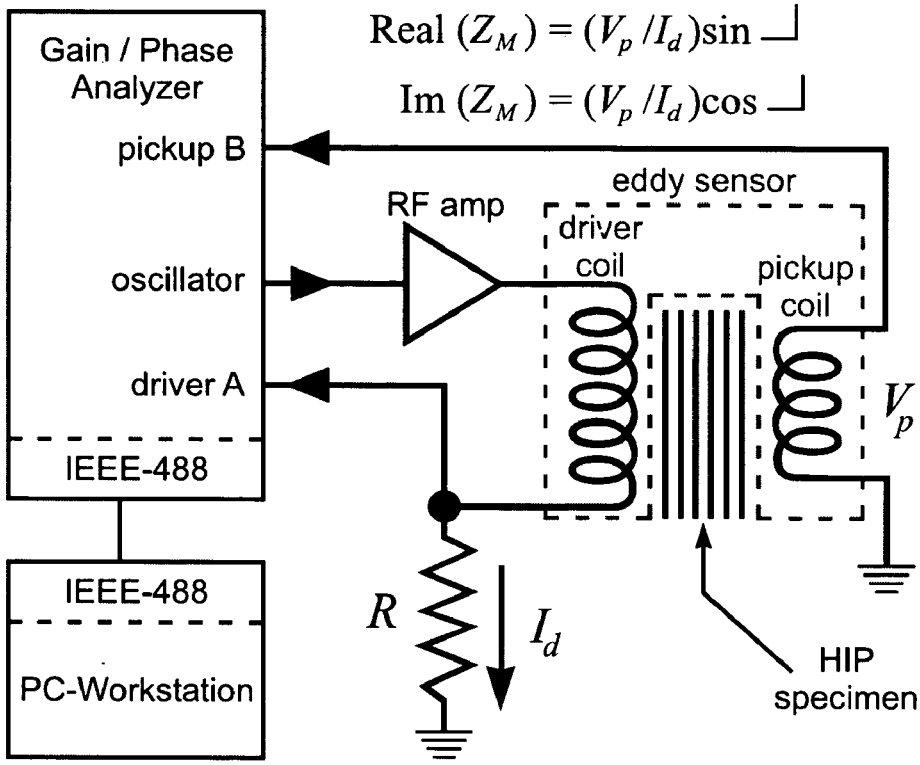
FIG. 1. Schematic drawing of an exemplary high temperature eddy current sensor (HiTECS) system, identifying the driver and pick-up coils, specimen, coupled-impedance circuit, signal conditioning and analyzing electronics, and data acquisition system.

In one aspect of the methods of the invention, the ability to identify and utilize a processing window in the controlled isostatic heating of MGA and MGA powders is involved. At room temperatures the MGA is in a deeply undercooled state. Below the glass transition temperature ($T_g$), the MGA is vitreous, having an extremely high viscosity, implying that the atoms are essentially immobile. Upon heating, passing through $T_g$, the MGA devitrifies. Above this temperature, the atoms become more mobile, and there is a rapid decrease in viscosity, thus the MGA behaves as a highly viscous, yet flowing liquid. However, above a certain temperature, i.e., the crystallization temperature ($T_x$) nucleation and growth of crystalline phases in this liquid may readily occur. The number of crystallization temperatures can vary from one to several and is different for each MGA.

Therefore, a processing window of opportunity exists in MGAs in the temperature interval ($\Delta T$) between the glass transition temperature ($T_g$) and the first crystallization temperature ($T_{x1}$). The width of this temperature window ($\Delta T = T_{x1} - T_g$) defines the processability of the alloy. The amorphous MGA powder can be heated in the $\Delta T$ region for some time without crystallization occurring. A consolidation process can be developed to take advantage of this processing window and minimize or eliminate crystallization.

Proper control of the devitrification sequence may result in features that consist of uniformly dispersed nanoscale-sized crystallites in a mostly glassy matrix to a bulk solid structure that is fully crystalline. This is equivalent to a structural composite with having medium to long range order.

In another aspect of the invention, the methods are employed to develop a reliable and scaleable process to produce large monolithic and composite structures from MGAs, e.g., high-density refractory metal (tungsten) and reinforced heavy alloy composites. While tungsten is a preferred refractory metal for use or in the invention, other refractory metals include molybdenum, tantalum, columbium (also known as niobium), chromium, rhenium, vanadium, boron, hafnium, cobalt, and the rare earth metals, such as cerium, lanthanum, and yttrium. One of skill in the art is aware of techniques and properties used to select a refractory metal for use in the invention.

One approach for creating large-scale MGA components would be to first produce gas-atomized, amorphous powders and then consolidate these powders into structural amorphous materials. The availability of inert-gas atomized, amorphous MGA powders opens a wide range of processing techniques for consolidation. These include vacuum hot pressing (VHP), warm isostatic pressing (WIP), hot isostatic pressing (HIP), hot extrusion, hot rolling, or a combination of any of these processes. Ideally for monolithic structures, the processing route will provide adequate flexibility and latitude such that it will preserve as much of the original amorphous structure of the powder as possible. However, a fully amorphous structure for many applications may or may not be advantageous.

A particularly advantageous process for the consolidation of large-scale size sections or pieces is hot isostatic pressing (HIP). The described approach in the preferred embodiment, in part, depends on the use of special version of HIP, employing a sensor system to monitor and optimize the densification of the amorphous powder or its blends during the consolidation cycle. The instrumentation is used for real-time control of the HIP schedule, thus allowing adjustments to change the exposure of the amorphous powder and/or its blends to each of pressure, temperature, or time, and/or combinations thereof. That is, the instrumentation directly facilitates control of the pressure, temperature, and time required to achieve full densification. For example, direct control of the process allows real time modification of the maximum temperature, and/or time at maximum temperature, to achieve the desired level of densification and/or the desired microstructure.

When applied to amorphous MGA powders for the fabrication of monolithic structures, the preferred embodiment allows for real-time control of the HIP product microstructure. Given the latitude in maximum temperature and time-at-temperature control, the product microstructure can be modified or controlled ranging from the retention of the original, mostly amorphous structure to an a priori selection of varying degrees of fine-scale structures or crystallinity, as introduced by controlled devitrification. That is, consolidated compacts of anywhere from being highly amorphous to fully crystalline can be expected to form, referred to as monolithic structural composites, heretofore.

A derivative of the aforementioned approach, demonstrated to be readily applicable to monolithic MGA-based structural material composites, is the application to the fabrication of structural amorphous material composites, based on a plurality of amorphous MGA and refractory metal powder mixtures. However, the consolidation of refractory metal reinforced MGA matrix composites, such as those based on tungsten for the reinforcement metal component, requires variations in the treatment schedules. Specifically, treatment at temperatures above the crystallization temperature of the amorphous MGA powder is necessary to achieve full density and bonding between the plurality of the MGA and tungsten phases. By itself, a refractory metal powder, especially pure tungsten, requires very high temperatures to achieve full consolidation. However, the use of tungsten powder with fine particle sizes reduces the maximum temperature required for full consolidation. Nevertheless, this reduced temperature still remains higher than the crystallization temperature of the amorphous powder.

In one embodiment, the hafnium-based MGA consists of generally spherical particles sieved at −45 μm. The tungsten powder used with the hafnium-based MGA-tungsten composite can be, and in the examples was, an off-the-shelf stock item 10401 from Alfa Aesar (Wardhill, Mass.). Nominally, it has a 12 μm average particle size.

In one embodiment, the iron-based MGA consists of generally spherical particles ranging in size from about 2 μm to about 15 μm. The tungsten powder used with the iron-based MGA-tungsten composite can be, and in the examples was, an off-the-shelf stock item P30-3 obtained from Alldyne Corporation (Huntsville, Ala.). Nominally, it is a sub-micrometer powder that agglomerates into 20 μm to 40 μm aggregates.

In order to enhance the properties of the composite, a preferred method uses ultrafine or submicron particles. In addition, in order to obtain the full benefit of the reinforcing particles in the composite, it is preferred to match the size of the MGA particles with the size of the refractory metal particles.

Again, an instrumented-HIP is used to monitor the densification of the refractory metal reinforced MGA matrix composite during the HIP cycle. As before, the HIP schedule can be adjusted in real time to identify the maximum temperature required for full consolidation and limit the exposure of the composite to the maximum temperature and the time at the maximum temperature in order to limit and minimize grain growth in each of the plurality of phases. Additionally, a secondary factor not present in the treatment of the monolithic MGA material can be considered. Possible physical and chemical interactions between the plurality of the primary phases may introduce interfacial reactions as such. Prudent control of the HIP process can limit such detrimental effects imparted to the mechanical properties of the composite. Conversely, control of the HIP process can also facilitate an enhancement of mechanical properties.

Figure 2:
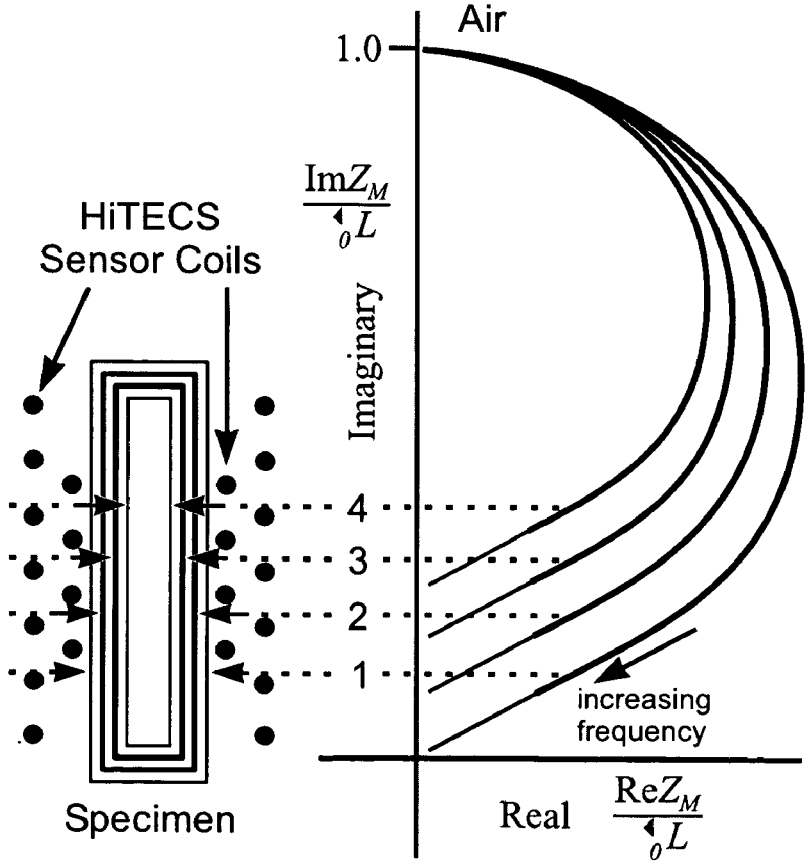
FIG. 2. Characteristic complex impedance curves plotted in the complex impedance plane for a broad input frequency span. Curves are shown for four sensor/specimen proximity cases that result from scanning the specimen over a broad input frequency range of 2 kHz to 800 kHz.

Thus, an instrumented-HIP can be used in the methods of the invention for consolidation of monolithic bulk metallic glass alloys and composites derived from amorphous powder specimens. The instrumented-HIP can be operated at high temperatures, for example up to 1,250° C. The instrumentation is preferably PC-based and depends on a high temperature eddy current sensor (HiTECS) that is used for monitoring the consolidation process. HiTECS, based on the principle of eddy current sensing, relies on a combination of two effects, electromagnetic and magneto-electric. These effects are controlled and measured respectively to achieve shape change and property measurements of electrically conductive materials in close proximity to the sensor coils. The global sensor design, used to measure cylindrical specimens, consists of loosely wound concentric platinum coils around cylindrical boron nitride insulators. The outer "drive coil" is swept with a broadband signal, which is inductively coupled to a second platinum inner coil known as the "pickup coil." Wide shallow grooves allow the coil wire to expand and contract under thermal loading along the sensor's axial dimension while constraining its radial movement. This simple design maintains a constant fill factor (i.e., relative radial position) between the drive and pickup coils, providing an integral mechanical-thermal compensation of the sensor response. The sensor response to conductive materials is affected by a change in the mutual inductance of the coils. The two-coil transfer impedance can be measured by $Z_m=V_p/I_d$, where $V_p$ is the voltage across the pickup coil and $I_d$ is the current in the driver coil, as illustrated in FIG. 1. The complex impedance plane for a broad frequency span yields characteristic curves, as illustrated in FIG. 2. Measurements of geometrical changes that occur to the specimen during processing requires the application of the eddy current "skin effect" given by:

$$\delta=(\pi f\mu\sigma)^{-1/2}$$

where,

δ=skin depth, f=frequency of the driving current,

μ=permeability, and

σ=conductivity of the specimen.

The sensor excitation frequency range is tuned for the conductivity of the specimen material so that the ideal penetrating depth of eddy currents can be selected. If the desired result is specimen dimensional change, high frequencies below the knee of the characteristic impedance curve are used. On the other hand, if sub-surface microstructural changes are desired, low frequencies above the knee of the characteristic impedance curve are used. As an example of this response, characteristic impedance curves are illustrated in FIG. 2 for four changes in sensor/specimen proximity, which result from scanning the specimen with a broad frequency sweep (2 kHz to 800 kHz). The measurement is normalized to the sensor response with no specimen present. As the high frequency points move up along the imaginary axis, the specimen is consolidating, i.e. moving away from the inside diameter of the sensor. Using a set of standards (precisely machined diameter tubes) a sensitivity equation is determined to convert imaginary intercept into diameter change. Using initial relative density and conservation of mass principles, the measured value of the diameter is translated into a relative density measurement of the material.

HiTECS consists of a set of hardware and software tools designed to measure material characteristics at elevated process temperature and pressure conditions. The system instrumentation provides automated sensor driver signals and data acquisition circuitry for 4 different types of high temperature eddy current sensors: medium sensitivity probe w/integral heater, high sensitivity probe, lift-off probe and high sensitivity encircling sensor.

The hardware includes global and/or probe type sensors made of two or more geometrically concentric ceramic spools with loosely wound platinum coils. The optional subassemblies include internal thermocouple, ceramic thermal shock shield, integral heater, and mineral insulated coax extension leads. The hardware also includes Impedance and Signal Conditioning Instrumentation, which includes a programmable signal source, primary and secondary power amplifiers and a custom signal conditioner circuit composed of a distributed I/O, a high wattage sensor primary non-inductive resistor voltage divider circuit, voltage attenuators, and RF baluns. The characterization and measurement software is divided into five main subroutines: (1) Configuration which includes three measurement databases; (2) Calibration which includes sensor calibration verification and thermal compensation calibration; (3) Measurement which controls sensor signal excitation and data acquisition; (4) Analysis which converts sensor data into various report formats; and (5) Heater Control which provides independent control of an integral sensor heater.

The HiTECS Sensor System is capable of measuring specimen material characteristics, such as dimensional shape changes, relative density, electrical conductivity, and fatigue states. The mechanical design features include: Thermal Shock Sheath made out of pyrolytic boron nitride; Sensor Spool Insulator made out of hot pressed boron nitride ceramic, $Al_2O_3$ or similar material; Extension Lead Insulation made out of alumina-borica-silica braided fiber, $Al_2O_3$ ceramic beads or mineral insulated coaxial cable; Main Conductor made out of platinum, platinum/13% rhodium; and Integral Thermocouple made out of Type 'R' platinum/13% rhodium or Type 'K' chromel/alumel.

The construction method preferably includes: electrical connections thermally fused in argon; and conductors inlayed and confined in tailored grooves. The groove width is 1.1-3 times the conductor diameter, and the groove depth is 1.05 times the conductor diameter. Conductor windings should be loosely spaced and surrounded by an appropriate insulator. The conductor is retained in its groove by successive layers of insulation. The conductor is free to move in the direction that is perpendicular to the sensor's measuring axis, while being constrained in the direction that is parallel to the sensor's measuring axis, and where conductor leads pass through insulation material, conductor pathways must be greater than twice the conductor diameter. Generally, all conductor pathways which force a change in conductor direction must have gentle slow arching bends and contours with all insulator throughway inlets and outlets fashioned with elliptical funnel shaped openings to avoid stress concentrations induced by thermal expansion effects.

The circuitry includes a primary circuit and a secondary circuit. The primary circuit includes: Signal Generation with a stable programmable sine wave function generator, 100 Hz-1.5 Mhz; Signal Conditioning and Coupling with a voltage divider circuit with high wattage non-inductive resistor and high bandwidth 0-25 db attenuator and RF balun; Amplification with either high power broad band (2.5 Kilowatt, 20 Hz-200 Khz) or RF custom amplification (100 Watt, 15 Khz-12 Mhz) depending on application; and High Speed DAC with a PCI based, 10 Hz-25 Mhz, 8 MB Memory.

The secondary circuit includes: Signal Conditioning and Coupling with high bandwidth 0-25 db attenuator and RF balun; Amplification with either high power broad band (2.5 Kilowatt, 20 Hz-200 Khz) or RF custom amplification (100 Watt, 15 Khz-12 Mhz) depending on application; and High Speed DAC with PCI based, 10 Hz-25 Mhz, 8 MB Memory; and Process Sensor Circuit with a 4-Channel Distributed I/O (expandable to 64 Channels).

The preferred embodiment relies on the use of, but is not limited to, hafnium-based or iron-based metallic glass alloys (MGA)s, atomized into finely divided amorphous powders.

The first exemplary MGA powder is hafnium-based, with a nominal composition of $Hf_{44.5}Ti_5Cu_{27}Ni_{13.5}Al_{10}$, has a theoretical density of 10.9 g/cm$^3$. The MGA has a distinct glass transition temperature ($T_g$) at approximately 500° C., exhibits a single crystallization event at ($T_x$) of about 560° C., a solidus occurring at around 970° C., and a liquidus occurring at around 995° C.

The second exemplary MGA powder is iron-based, with a nominal composition of $Fe_{58.3}B_{16}Cr_{14.6}C_4Mn_2Mo_2W_2Si_1$, has theoretical density of 7.26 g/cm$^3$. The MGA has an approximate glass transition temperature ($T_g$) of 580° C., exhibits a single crystallization event at ($T_x$) of about 590° C., a solidus occurring at around 1,130° C., and a liquidus occurring at around 1,165° C.

For the preferred embodiment, instrumented-HIP experiments are typically performed on, but not limited to, cylindrical HIP canisters with diameters ranging from 12.7 mm (0.5 inches) up to 127 mm (5 inches) and length ranging from 50.8 mm (2 inches) up to 203.2 mm (8 inches).

The HIP canister may be filled with finely divided amorphous MGA powders. Alternatively, the HIP canister may be filled with a mixture of the amorphous MGA powder and refractory metal powder, e.g., tungsten, tantalum, or molybdenum, or combinations thereof. Dimensional and weight measurements are performed on the empty and full canister in order to estimate the initial powder packing (fill) density.

When the preferred embodiment is used for the fabrication of structural composite materials, the HIP canister may be filled with the appropriately divided powder blend. Prior to filling, the blend of amorphous and refractory metal, e.g., tungsten, powders is prepared. First the amount of the amorphous MGA powder and the amount of tungsten powder are weighed out to achieve the desired target composition for the composite. In the preferred embodiments, the desired composite has 10 to 30 vol. % of amorphous MGA powder and 70 to 90 vol. % of tungsten powder. The two powdered materials are loaded in a V-blender and mixed until a homogeneous blend is achieved.

The canister is then evacuated and sealed by electron-beam welding. The canister then is inserted inside the sensor and the diameter is measured in real-time during consolidation. The measured diameter can be converted in real time into a relative density measurement for the compact. In addition, the slope of the diameter measurement is proportional to the densification rate of the material. A flat portion of the curve, with a zero slope, indicates zero densification and may indicate that full densification has been reached.

Figure 3:
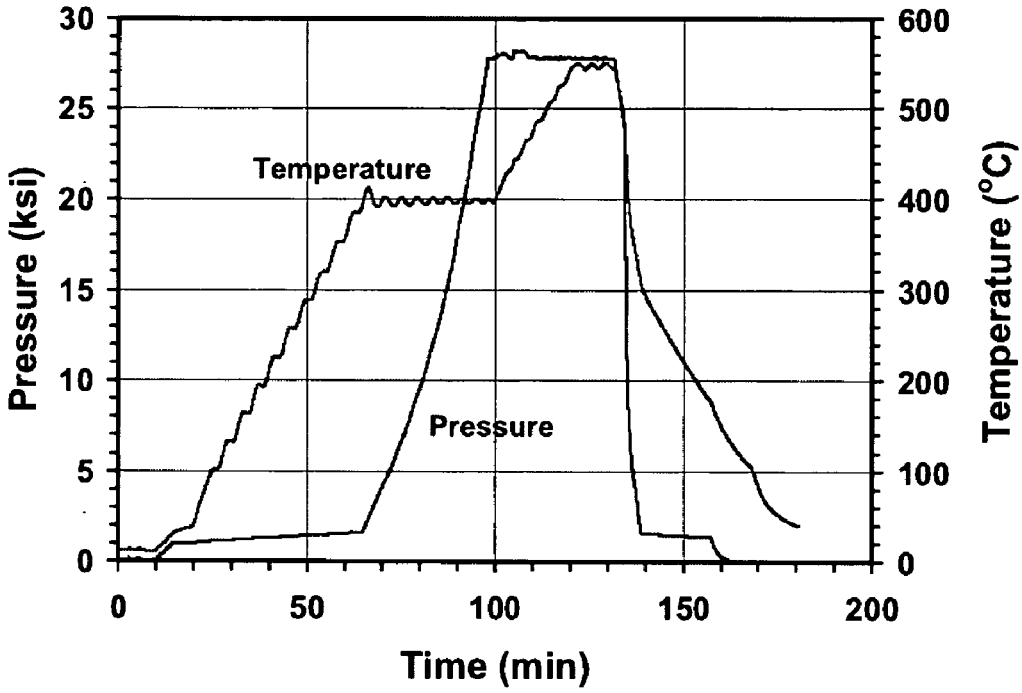
FIG. 3. Plot of the pressure and temperature during the hot isostatic pressing (HIP) cycle as a function of time for the case of an exemplary monolithic structural composite of metallic glass alloy of the invention.
Figure 4:
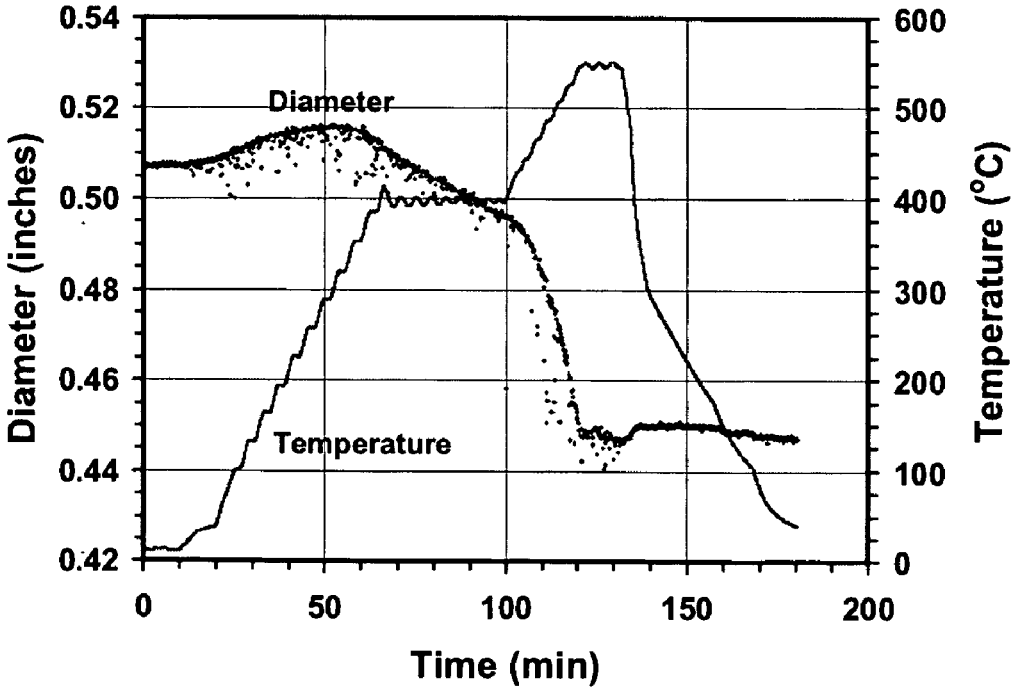
FIG. 4. Plot of the hot isostatic pressing (HIP) canister diameter change as measured by the high temperature eddy current sensor (HiTECS) system as a function of time for an exemplary monolithic structural composite of metallic glass alloy. The temperature schedule is superimposed on the graph for reference.

A typical HIP schedule used in the preferred embodiment is illustrated in FIG. 3, where pressure and temperature measurements, taken during the HIP run, are shown. The corresponding HIP canister diameter change measured by HiTECS is illustrated in FIG. 4. In the preferred embodiment, the HIP temperature is initially increased to a temperature of 400° C. and held there, at below the crystallization temperature of the exemplary MGA powder. Then, the pressure is increased and held at its maximum value, in this case 193 MPa (28 ksi). As shown in the figures, subsequently, the temperature is increased to 550° C., the next set point, held there for 15 minutes, and densification is observed and monitored.

It is emphasized that once the densification stops, as signified by no further diameter change (refer to FIG. 4), the temperature is cut off, as was the case here. Alternatively, it can also be ramped to a higher set point. At each set point, the temperature may be held constant for a variable length of time, usually measured in minutes. When the level of densification is assured to be satisfactory, the HIP may then be cooled and the specimen removed.

The measurement, illustrated in FIGS. 3 and 4 for this exemplary MGA powder, demonstrates the unique features in the densification behavior of this type of amorphous MGA powder. The first feature is the very high densification rate of the amorphous powder once a critical temperature is reached. The second feature is the abrupt stop in densification, once the temperature equilibrates. Corresponding densification curves for a crystalline material are gradual, with the densification rate slowly decreasing as the material approaches full density. The latter case is unlike the behavior displayed by an amorphous powder.

The bulk of the consolidation, i.e., reaching full density, of the exemplary amorphous MGA powder occurred below the crystallization temperature. Full densification was reached for this material within a narrow processing window that would allow the material to remain fully amorphous. The bulk material density was measured as 10.9 g/cm$^3$, equivalent of the theoretical density for this alloy material. X-ray diffraction measurements show the bulk material has a high amorphous content and limited devitrification. This limited devitrification occurs as a result of the short hold at 550° C. for 15 minutes. Eliminating or reducing the duration of the hold at 550° C. would result in a fully amorphous bulk material. Conversely, a longer hold would produce further crystallization in the material.

The consolidation of the powder in this narrow temperature range allows the user to preserve the microstructure of the starting powder and control the microstructure of the bulk material.

Application of the HIP schedule for the fabrication of structural composite materials comprising of mixtures of amorphous MGA and refractory metal powders is a direct extension of the aforementioned method used for the monolithic structural materials.

However, due to the nature of the refractory metal powder component comprising a substantial part of the composite, the HIP schedule is somewhat modified. While, all of the HiTECS instrumentation and pressure excursions are unchanged, higher HIP temperatures, e.g., 1,050° C., can be used to densify the refractory metal component.

Figure 5:
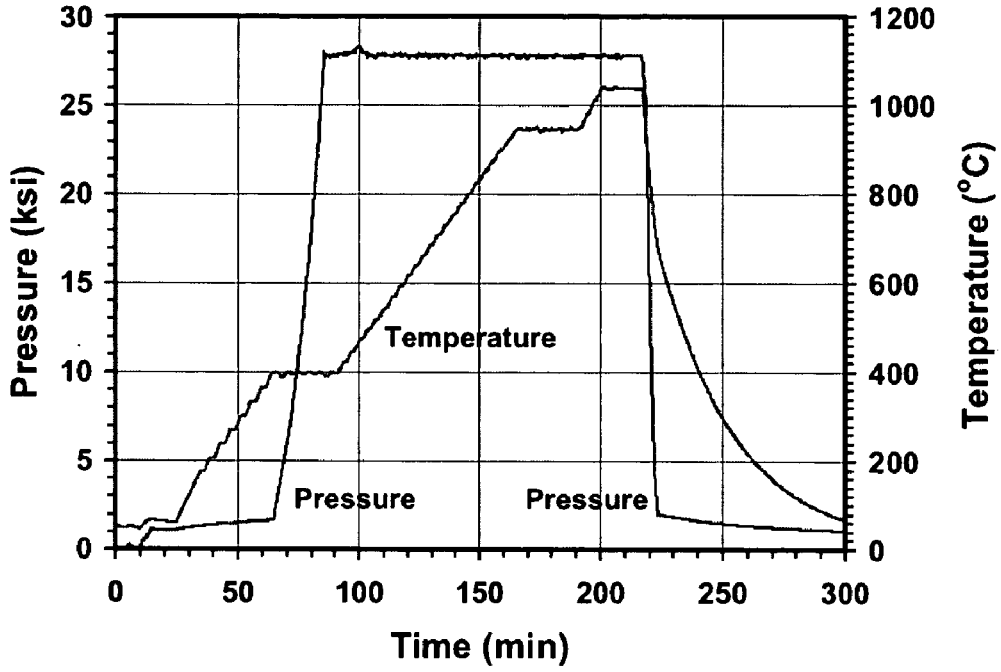
FIG. 5. Plot of the pressure and temperature during the hot isostatic pressing (HIP) cycle as a function of time for the case of an exemplary structural composite of metallic glass alloy and tungsten.
Figure 6:
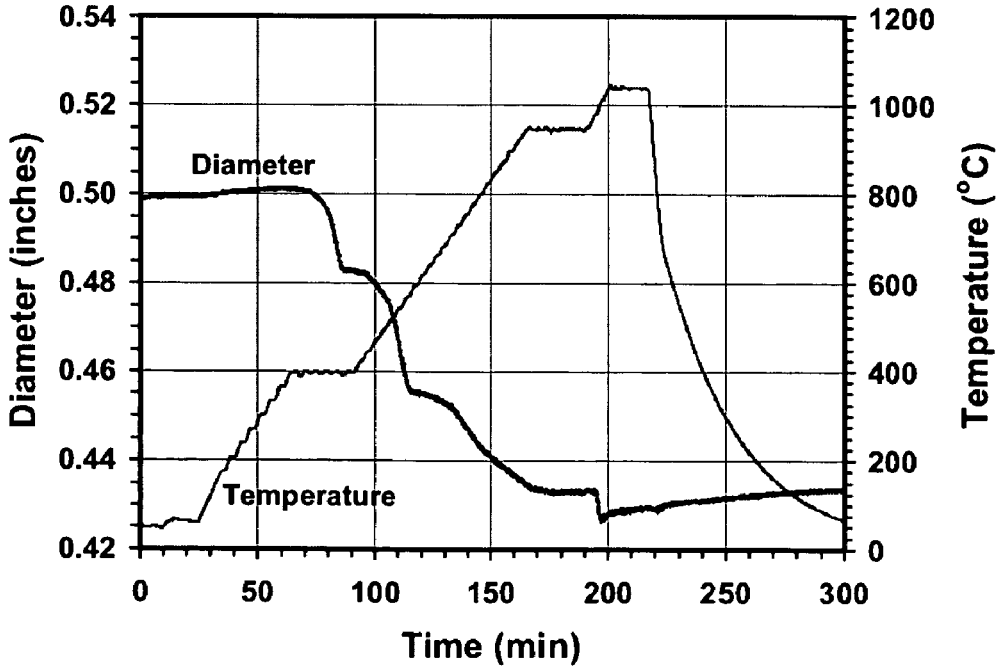
FIG. 6. Plot of the hot isostatic pressing (HIP) canister diameter change as measured by the HiTECS system as a function of time for the exemplary structural composite of metallic glass alloy and tungsten. The temperature schedule is superimposed on the graph for reference.

The temperature and pressure schedules as well as the in-situ diameter measurements, illustrated in FIGS. 5 and 6, respectively, reveal that densification in the composite occurs, in essence, independently for each of the two component phases. That is, the overall consolidation curve is a superposition of the individual densification curves of each component. Densification of the MGA powder component begins near its glass transition and crystallization temperatures ($T_g$ and $T_x$, respectively) and is mostly completed within 100 to 150° C. above these temperatures. Further densification of the composite occurs, however, this, more gradual consolidation occurs steadily as the temperature increases. This corresponds to the characteristic behavior of the crystalline tungsten powder, as it starts to densify. Most of the densification occurs over a wider temperature range, up to 950° C. Once the temperature increases above the liquidus of the MGA, typically near 1,000° C., the MGA becomes a liquid. The presence of the liquid enables further rapid, almost instantaneous, densification to full density, and is signified by an almost vertical drop in the measurement of the diameter.

A most unique feature of the preferred embodiment is the control of the structural composite microstructure during elevated temperature processing. As the material is exposed to further temperature increases, the refractory metal, e.g., tungsten, powder interacts with the MGA powder to form a third interfacial phase. If the reaction produces a new phase with a lower specific volume than any of the plurality of the other components, there will be a reversal or expansion, corresponding to an increase in the HIP canister diameter. In turn, the interfacial compound will lead to a concomitant discontinuity of chemical, physical, or mechanical properties of the composite material. As such, it is desirable to terminate the temperature rise once the MGA powder has liquefied and full densification is observed, but before the third phase is allowed to form.

Conversely, if the MGA and refractory metal components can be selected in a manner that ensures chemical, physical, and mechanical compatibility of the plurality of existing and possible intermediate phases, then the role of the interfacial compound that forms is not necessarily undesirable. That is, exposure of the composite material to high temperatures or continued increase in temperature allows further development of the third phase along the interface between the tungsten powder and the iron-based powder. In turn, this action will improve the structural composite material.

It should be emphasized that the above-described embodiments and following specific examples of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

EXAMPLES

Example 1

Consolidation of Monolithic Hafnium-Based MGA Material

This preferred embodiment relies on the use of the hafnium-based MGA, atomized into finely divided amorphous powder. For this powder, the glass transition temperature ($T_g$) is about 500° C., it exhibits a single crystallization event ($T_x$) at about 560° C., its solidus occurs at 970° C., and its liquidus occurs at 995° C.

For the preferred embodiment, instrumented-HIP experiments are typically performed on, but not limited to, cylindrical HIP canisters with diameter from 12.7 mm (0.5 inches) up to 127 mm (5 inches) and length from 50.8 mm (2 inches) up to 203.2 mm (8 inches). The HIP canister is filled with the MGA powder. Dimensional and weight measurements are performed on the empty and full canister in order to estimate the initial powder packing (fill) density. The canister is then evacuated and sealed by electron-beam welding. The canister then is inserted inside the sensor and the diameter is measured in real-time during consolidation. The measured diameter can be converted in real time into a relative density measurement for the compact. In addition, the slope of the diameter measurement is proportional to the densification rate of the material. A flat portion of the curve, with a zero slope, indicates zero densification and may indicate that full densification has been reached.

Figure 7:
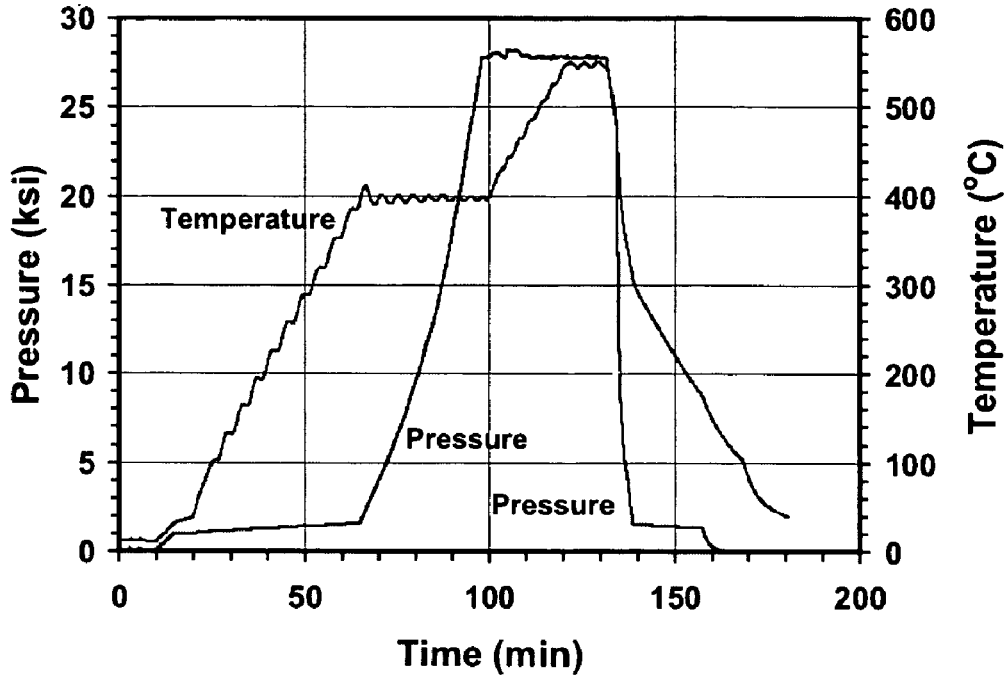
FIG. 7. Plot of the pressure and temperature during the hot isostatic pressing (HIP) cycle as a function of time for the case of an exemplary monolithic structural composite of hafnium-based metallic glass alloy.
Figure 8:
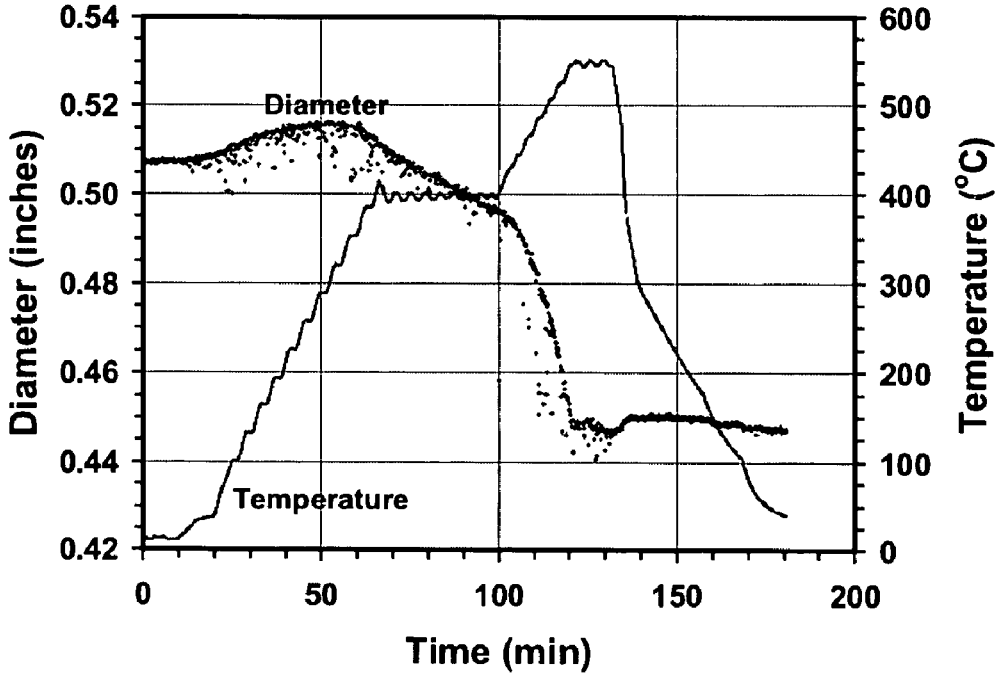
FIG. 8. Plot of the hot isostatic pressing (HIP) canister diameter change as measured by the high temperature eddy current sensor (HiTECS) system as a function of time for an exemplary monolithic structural composite of hafnium-based metallic glass alloy. The temperature schedule is superimposed on the graph for reference.

The HIP schedule used in the preferred embodiment already illustrated in FIG. 7, where pressure and temperature measurements, taken during the HIP run, are shown. The corresponding HIP canister diameter change measured by HiTECS is illustrated in FIG. 8. The HIP temperature is initially increased to a temperature and held there, at below the crystallization temperature of the powder, 400° C. in this case. Then, the pressure is increased and held at its maximum value, in this case 193 MPa (28 ksi). Subsequently, the temperature is increased and fast densification is observed. Once the densification stops, as signified by no further diameter change, the temperature rise is cutoff, in this case at 550° C. Subsequently, the temperature is held constant for 15 minutes. The HIP is then cooled and the specimen is removed.

The measurement illustrates two unique features in the densification behavior of this MGA powder. The first feature is the very high densification rate once a critical temperature is reached. This temperature is below the crystallization temperature ($T_x$) of this powder. The second feature is the abrupt stop in densification. Typically for crystalline alloys, the densification rate decreases as the material approaches full density unlike the behavior displayed by an amorphous powder.

The consolidation of the powder occurred below the crystallization temperature. Full densification was reached for this material within a narrow processing window that would allow the material to remain fully amorphous. The bulk material density was measured as 10.9 g/cm$^3$, equivalent to the theoretical density for this alloy material. X-ray diffraction measurements show the bulk material has a high amorphous content and limited devitrification. This limited devitrification occurs as a result of the short hold at 550° C. for 15 minutes. Eliminating the hold at 550° C. would result in a fully amorphous bulk material.

The consolidation of the powder in this narrow temperature range allows the user to preserve the microstructure of the starting powder and control the microstructure of the bulk material.

Figure 9:
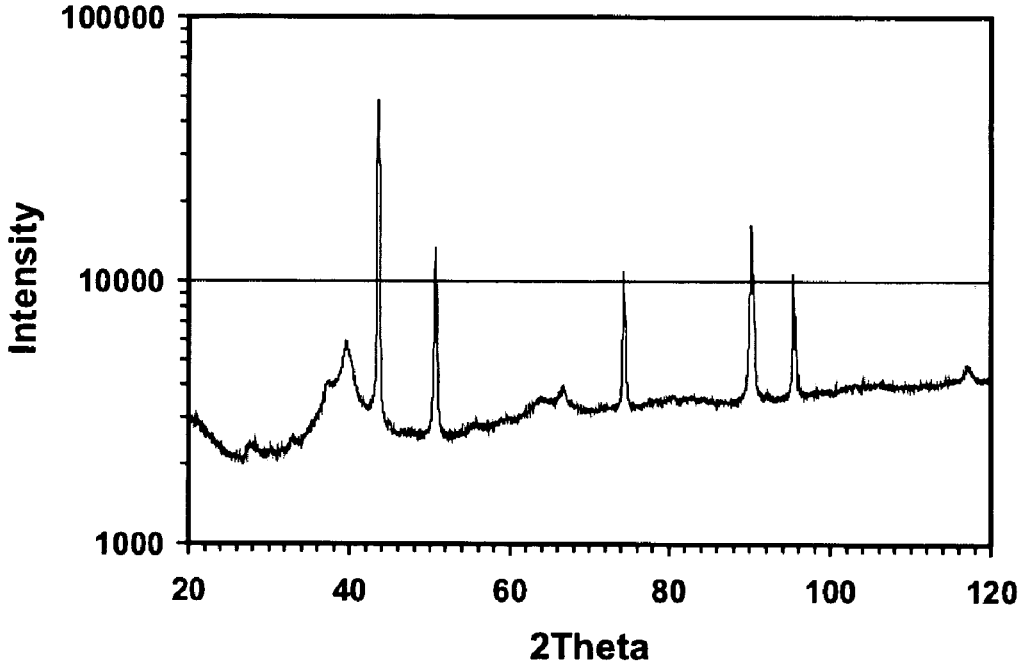
FIG. 9. X-ray diffractogram of an exemplary monolithic structural composite of hafnium-based metallic glass alloy resulting from the hot isostatic pressing (HIP) cycle, including the sharp, intense Bragg-type peaks from the copper container holding the specimen.
Figure 10:
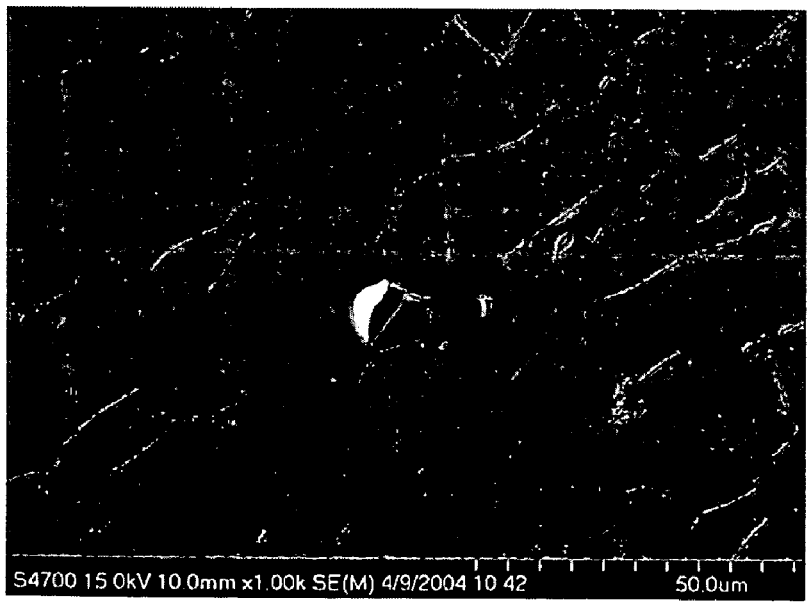
FIG. 10. Scanning electron micrograph of the resultant material substructure showing minimal recrystallization of an exemplary monolithic structural composite of hafnium-based metallic glass alloy, as evidenced by the fine atomic number contrast.

As shown in FIGS. 9 and 10, the X-ray diffractogram and corresponding scanning electron micrograph of the resultant material structure showing little or minimal crystalline content of the HIPed material.

Example 2

Consolidation of Monolithic Iron-Based MGA Material

This preferred embodiment relies on the use of the iron-based MGA, atomized into finely divided amorphous powder. For this powder, the glass transition temperature ($T_g$) is about 580° C., it exhibits a single crystallization event ($T_x$) at about 590° C., its solidus occurs at 1,130° C., and its liquidus occurs at 1,165° C.

For the preferred embodiment, instrumented-HIP experiments are typically performed on, but not limited to, cylindrical HIP canisters with diameter from 12.7 mm (0.5 inches) up to 127 mm (5 inches) and length from 50.8 mm (2 inches) up to 203.2 mm (8 inches). The HIP canister is filled with the MGA powder. Dimensional and weight measurements are performed on the empty and full canister in order to estimate the initial powder packing (fill) density. The canister is then evacuated and sealed by electron-beam welding. The canister then is inserted inside the sensor and the diameter is measured in real-time during consolidation. The measured diameter can be converted in real time into a relative density measurement for the compact. In addition, the slope of the diameter measurement is proportional to the densification rate of the material. A flat portion of the curve, with a zero slope, indicates zero densification and may indicate that full densification has been reached.

Figure 11:
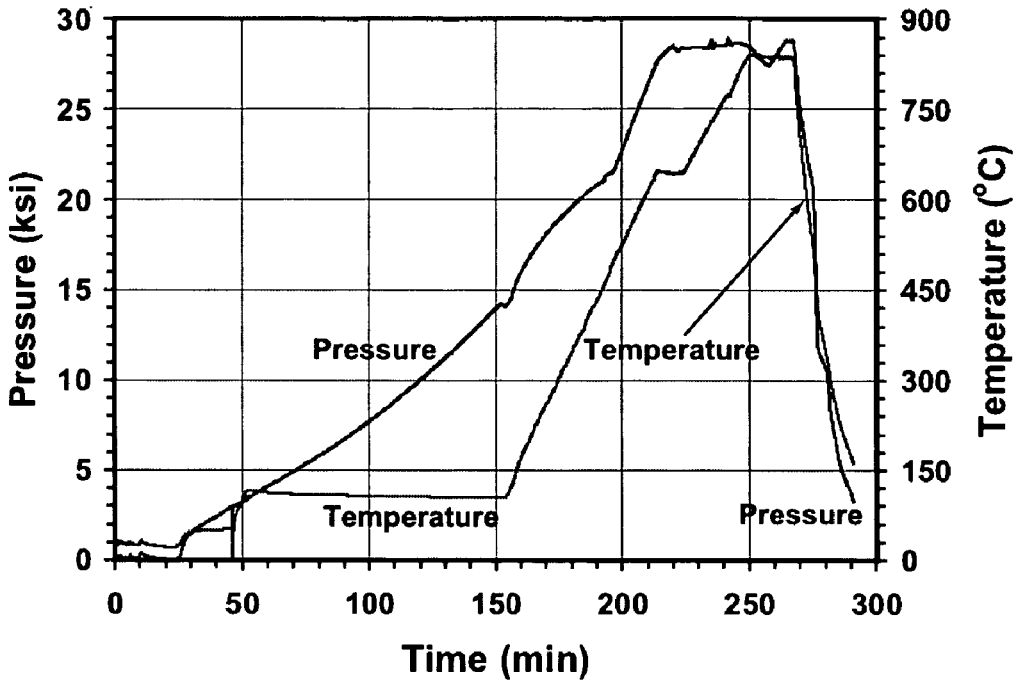
FIG. 11. Plot of the pressure and temperature during the hot isostatic pressing (HIP) cycle as a function of time for the case of an exemplary monolithic structural composite of iron-based metallic glass alloy.
Figure 12:
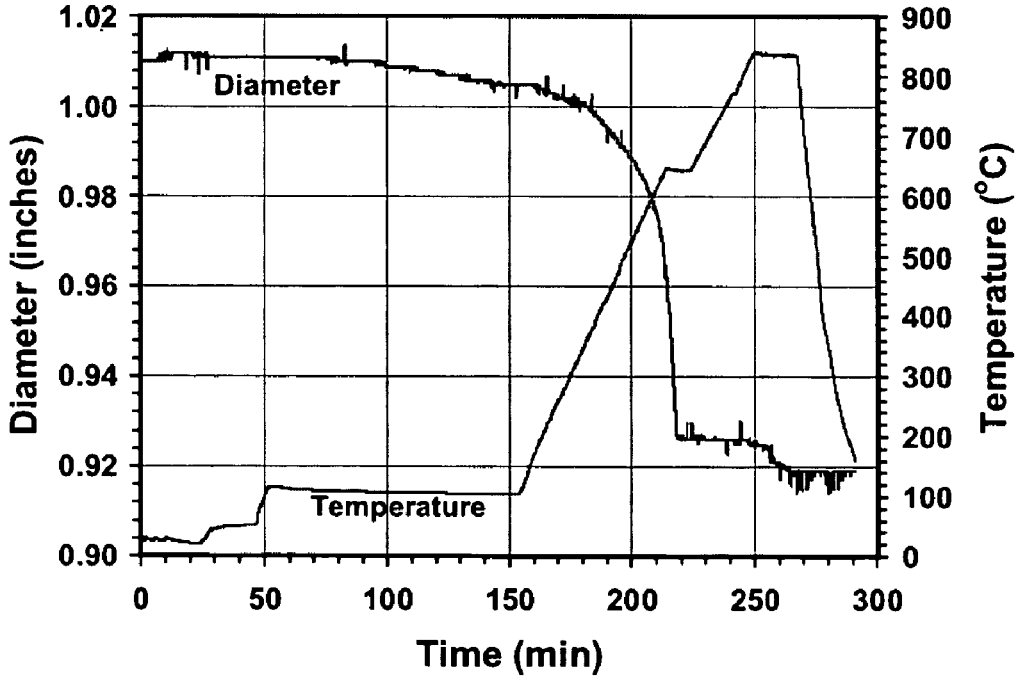
FIG. 12. Plot of the hot isostatic pressing (HIP) canister diameter change as measured by the high temperature eddy current sensor (HiTECS) system as a function of time for an exemplary monolithic structural composite of iron-based metallic glass alloy. The temperature schedule is superimposed on the graph for reference.

The HIP schedule used in the preferred embodiment already illustrated in FIG. 11, where pressure and temperature measurements, taken during the HIP run, are shown. The corresponding HIP canister diameter change measured by HiTECS is illustrated in FIG. 12. The HIP temperature is initially increased to a temperature and held there, at below the crystallization temperature of the powder, 590° C. in this case. Then, the pressure is increased and held at maximum value, in this case 193 MPa (28 ksi). Subsequently, the temperature is increased and fast densification is observed. Once the densification stops, as signified by no further diameter change, the temperature rise is cutoff, in this case at 850° C. Subsequently, the temperature is held constant for 20 minutes. The HIP is then cooled and the specimen is removed.

The measurement illustrates two unique features in the densification behavior of this MGA powder. The first feature is the very high densification rate once a critical temperature is reached. This temperature is above the crystallization temperature ($T_x$) of this powder. The second feature is the abrupt stop in densification. Typically for crystalline alloys, the densification rate decreases as the material approaches full density unlike the behavior displayed by this amorphous powder.

The bulk of the consolidation of the powder occurred as the HIP temperature increased just above the crystallization temperature. Near-full densification was reached for this material within a narrow processing window. The bulk material density was measured as 7.26 g/cm$^3$, equivalent to 99.6% of the theoretical density for this material.

Figure 13:
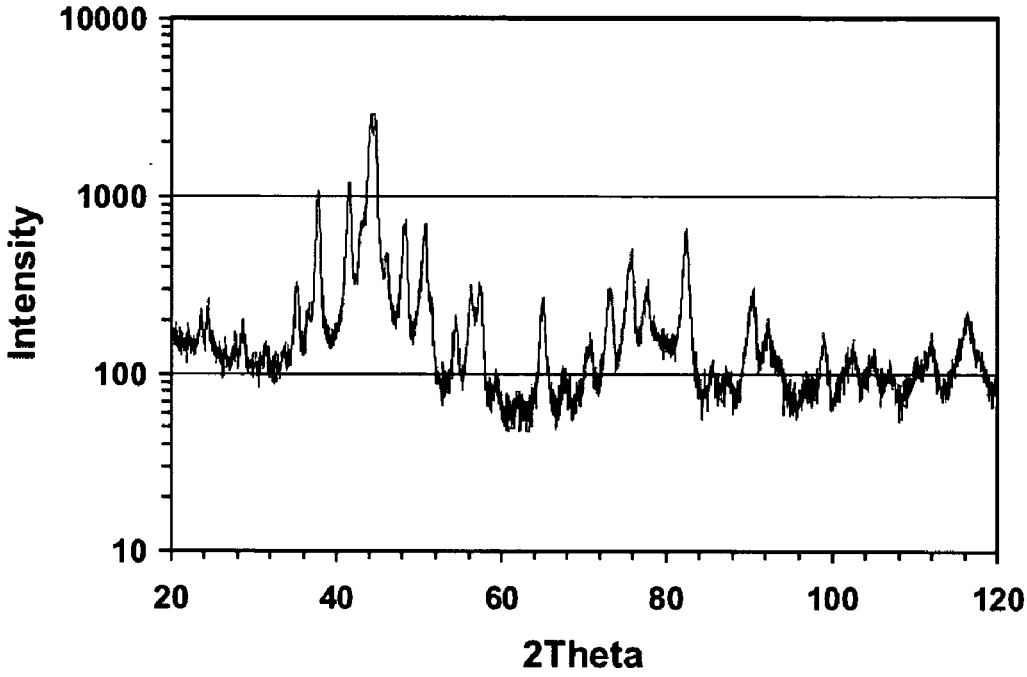
FIG. 13. X-ray diffractogram of an exemplary monolithic structural composite of iron-based metallic glass alloy resulting from the hot isostatic pressing (HIP) cycle.

As shown in FIG. 13, X-ray diffraction measurements reveal a series of Bragg-type peaks superpositioned over two relatively large wide amorphous features. This corresponds to the presence of two types of structures having fine nanoscaled crystallites dispersed in an otherwise mostly amorphous bulk material with partial devitrification. This structure occurs as a result of the rapid temperature rise to 850° C. and a subsequent hold for 20 minutes. Eliminating or reducing the hold time at 850° C. would increase the amorphous content of the bulk material.

Figure 14:
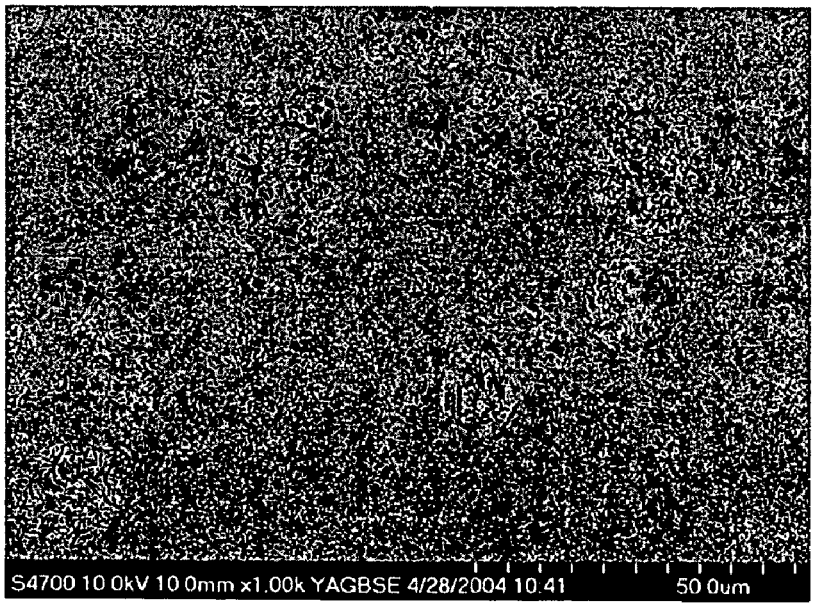
FIG. 14. Scanning electron micrograph of the resultant material substructure showing recrystallization of an exemplary monolithic structural composite of iron-based metallic glass alloy.

As shown in FIG. 14, the scanning electron micrograph of the resultant material structure shows full densification with no porosity. The fine speckled appearance of the micrograph is indicative of the partial devitrification of the iron-based MGA into a monolithic structural composite.

This example demonstrates the flexibility of this methodology that easily allows the control over the material's substructure that varies from being nanostructured to fully amorphous.

Example 3

Consolidation of Hafnium-Based MGA-Tungsten Composite Material

The experiments are performed on a blend of the hafnium-based MGA and tungsten powders. First the amount of hafnium-based MGA powder and the amount of tungsten powder are weighed out to achieve the desired target composition for the composite. In this case, the desired composite has 30 vol. % of hafnium-based MGA powder and 70 vol. % of tungsten powder. The two materials are loaded in a V-shaped blender and mixed until a homogeneous blend is achieved.

Instrumented-HIP experiments on the composite MGA-tungsten materials are typically performed on, but not limited to, cylindrical HIP canisters with diameter from 12.7 mm (0.5 inches) up to 127 mm (5 inches) and length from 50.8 mm (2 inches) up to 203.2 mm (8 inches). The HIP canister is then filled with the powder blend, and dimensional and weight measurements are performed on the empty and full canister in order to estimate the initial powder packing (fill) density. The canister is then evacuated and electron-beam welded. The HIP canister is then inserted inside the sensor and the diameter is measured in real-time during consolidation. The measured diameter can be converted in real time into relative density measurement for the compact. In addition, the slope of the diameter measurement is proportional to the densification rate of the material. A flat portion of the curve, or a zero slope, indicates zero densification and may indicate that full densification has been reached.

Figure 15:
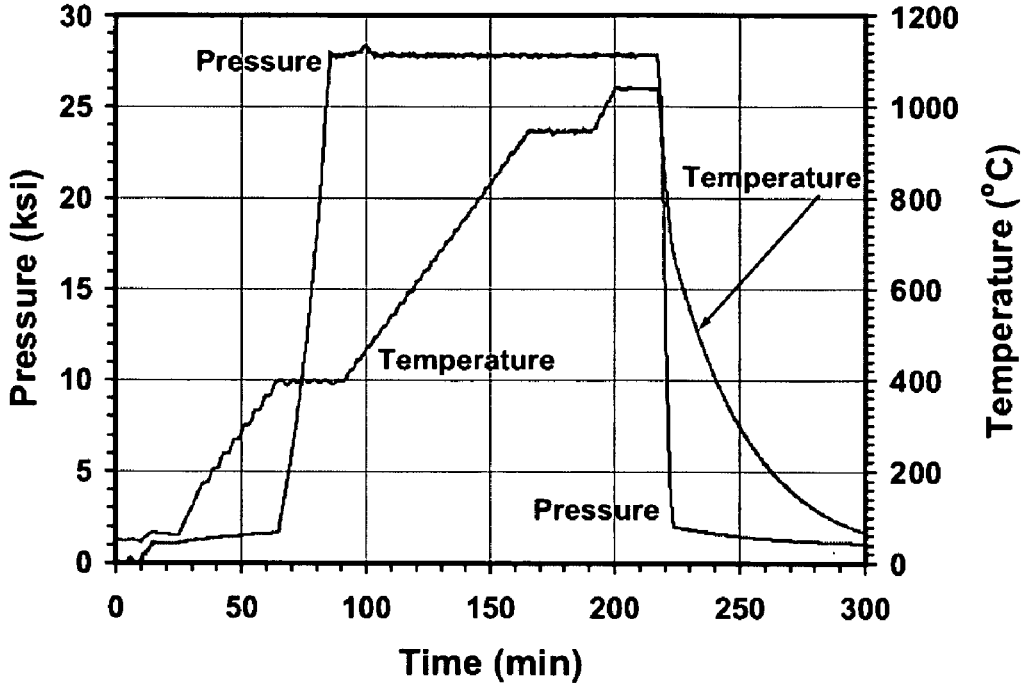
FIG. 15. Plot of the pressure and temperature during the hot isostatic pressing (HIP) cycle as a function of time for the case of an exemplary structural composite of hafnium-based metallic glass alloy and tungsten.
Figure 16:
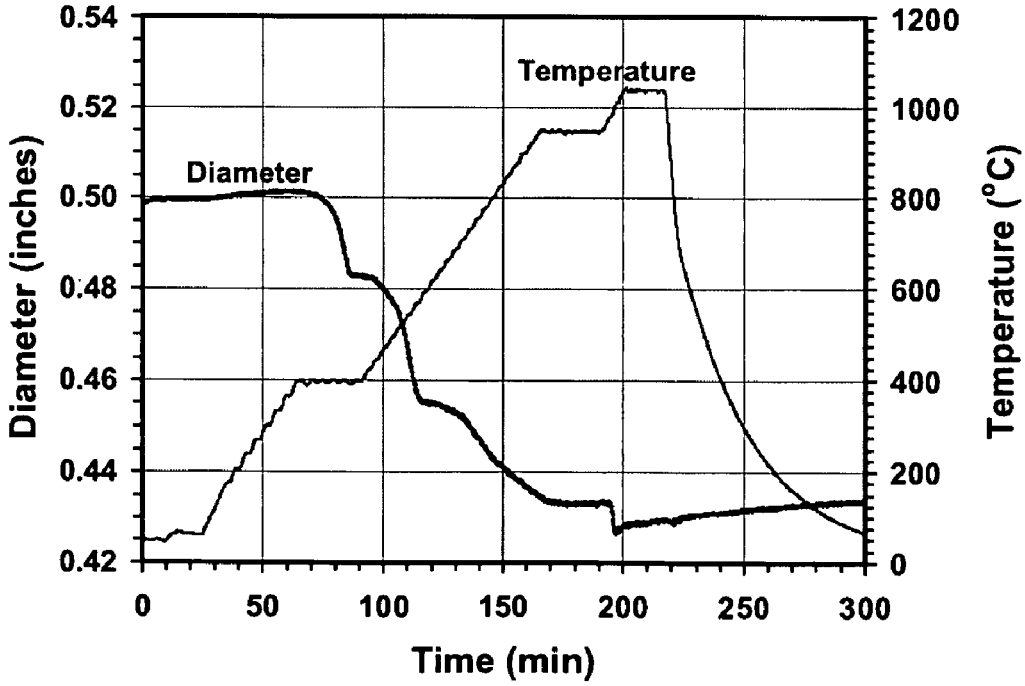
FIG. 16. Plot of the hot isostatic pressing (HIP) canister diameter change as measured by the HiTECS system as a function of time for the exemplary structural composite of hafnium-based metallic glass alloy and tungsten. The temperature schedule is superimposed on the graph for reference.

The HIP schedule used for this experiment is illustrated in FIG. 15 where pressure and temperature measurements taken during the HIP run are shown. The corresponding HIP canister diameter change measured by HiTECS is illustrated in FIG. 16. The HIP temperature is initially increased a temperature and held there well below the crystallization temperature, 400° C. in this case. Then, the pressure is increased and held at its maximum value, in this case 193 MPa (28 ksi). Subsequently, the temperature is increased to 1,050° C. and densification is monitored.

The measurements reveal that densification occurs, in essence, independently for each of the two component phases. That is, the overall consolidation curve shown in FIG. 16 is a superposition of the individual densification curves of each component. Partial densification of the hafnium-based powder component occurs at 400° C. Further densification occurs at 550° C. as the temperature is ramped up to its maximum value. The densification then stops as the temperature increases to 600° C., as signified by no change in diameter. Subsequently, above 600° C., a more gradual consolidation occurs as the temperature increases. This corresponds to the tungsten powder, as it starts to densify. Most of the densification occurs up to 950° C. Once the temperature increases above 970° C., the hafnium-based powder exceeds its liquidus, wherein it becomes a liquid. Additional densification occurs instantaneously at 1,010° C., as signified by the almost vertical drop in the measurement of the diameter.

As the material is exposed to further temperature increase, the tungsten powder reacts with the hafnium-based MGA powder to form a third phase. This new phase has lower specific volume, which causes a reversal or expansion, corresponding to an increase in the measurement of diameter. Exposure of the composite material to this high temperature or continued increase in temperature causes the further development of the third phase along the interface between the tungsten powder and hafnium-based powder. In some cases the interfacial compound leads to undesirable mechanical properties for the composite material. As such, it is desirable to terminate the temperature rise once the hafnium-based powder has liquefied and full densification is observed. Any hold at this maximum temperature or any further increase in temperature will allow the third phase to form.

Figure 17:
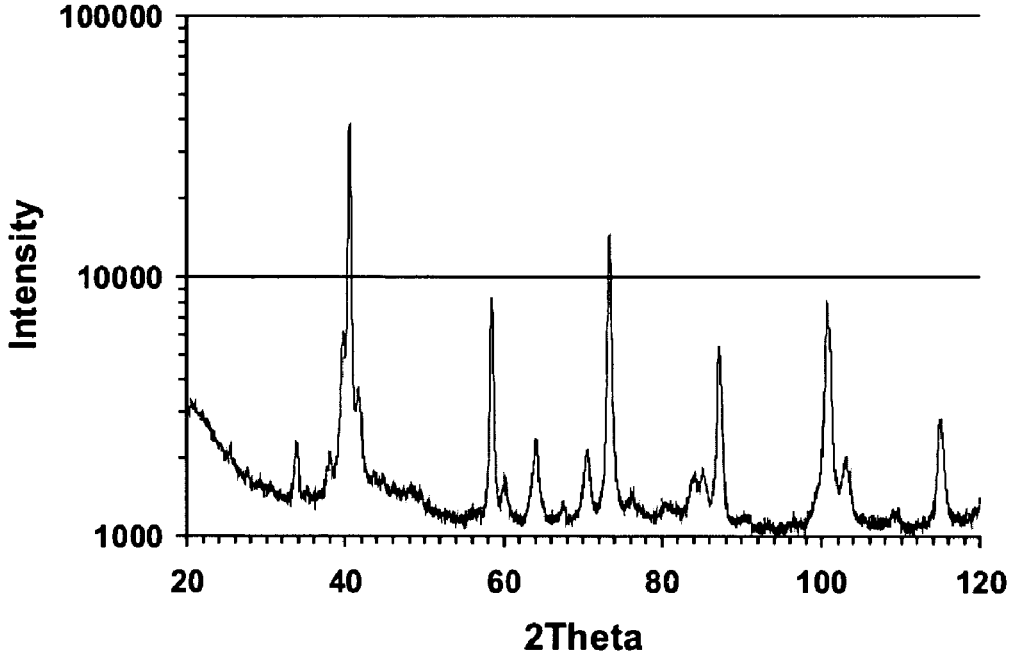
FIG. 17. X-ray diffractogram of an exemplary structural composite of hafnium-based metallic glass alloy and tungsten, resulting from the hot isostatic pressing (HIP) cycle. The sharp, intense Bragg-type peaks are from the tungsten phase. The other Bragg-type peaks are attributed to the interfacial tungsten-hafnium phase.

Full densification was reached for this composite material. The bulk material density was measured as 16.9 g/cm$^3$, the theoretical density for this composite material. Scanning electron microscopy of the resultant composite material, shown in FIG. 17, revealed a third crystalline phase which developed along the hafnium-based powder-tungsten interface as a result of over-exposure of the material to high temperature.

Figure 18:
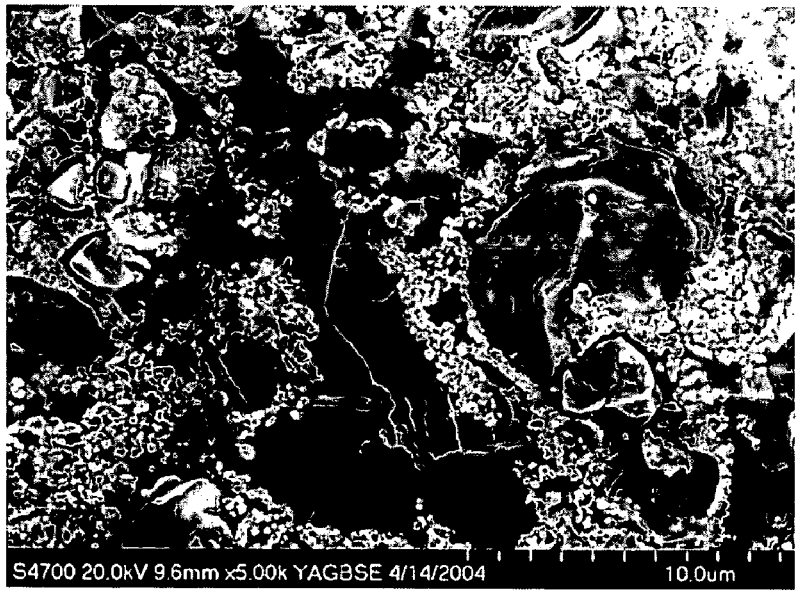
FIG. 18. Scanning electron fractograph of the resultant structural composite of hafnium-based metallic glass alloy and tungsten material substructure showing good strength, intermixing of the two phases, and the formation of an interfacial boundary layer.

Despite the presence of this third phase, wetting and bonding between the two phases is excellent as demonstrated by the scanning electron fractograph shown in FIG. 18. The failure surface of the tungsten phase appears to be partially trans- to intergranular. The MGA phase appears to be equally strong and well-bonded, exhibiting quasi-brittle fracture, as evidenced by the appearance of striations on the fracture surface.

Example 4

Consolidation of Iron-Based MGA-Tungsten Composite Material

The experiments are performed on a blend of the iron-based MGA and tungsten powders. First, the amount of iron-based MGA powder and the amount of tungsten powder are weighed out to achieve the desired target composition for the composite. In this case, the desired composite has 20 vol. % of iron-based MGA powder and 80 vol. % of tungsten powder. The two materials are loaded in a V-blender and mixed until a homogeneous blend is achieved.

Instrumented-HIP experiments on the composite MGA-tungsten materials are typically performed on, but not limited to, cylindrical HIP canisters with diameter from 12.7 mm (0.5 inches) up to 127 mm (5 inches) and length from 50.8 mm (2 inches) up to 203.2 mm (8 inches). The HIP canister is then filled with the powder blend, and dimensional and weight measurements are performed on the empty and full canister in order to estimate the initial powder packing (fill) density. The canister is then evacuated and electron-beam welded. The HIP canister is then inserted inside the sensor and the diameter is measured in real-time during consolidation. The measured diameter can be converted in real time into relative density measurement for the compact. In addition, the slope of the diameter measurement is proportional to the densification rate of the material. A flat portion of the curve, or a zero slope, indicates zero densification and may indicate that full densification has been reached.

Figure 19:
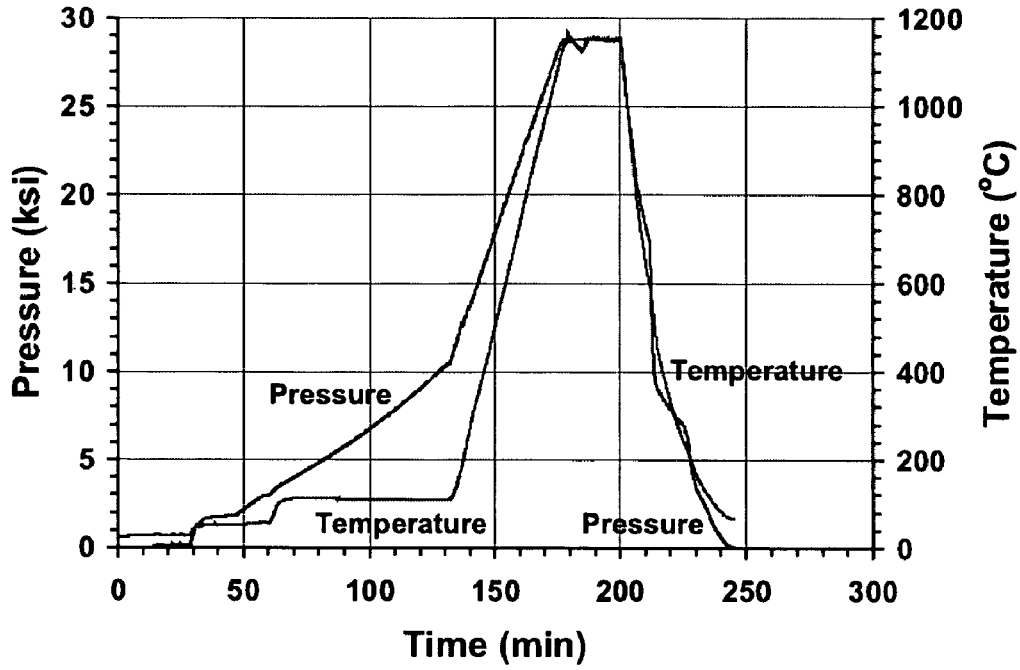
FIG. 19. Plot of the pressure and temperature during the hot isostatic pressing (HIP) cycle as a function of time for the case of an exemplary structural composite of iron-based metallic glass alloy and tungsten.
Figure 20:
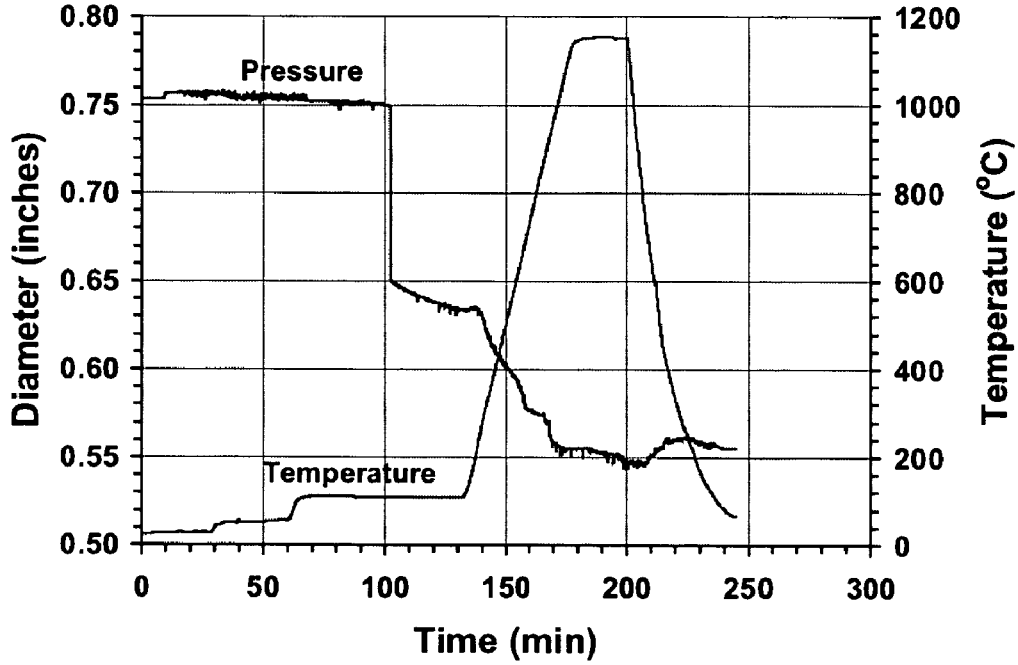
FIG. 20. Plot of the hot isostatic pressing (HIP) canister diameter change as measured by the HiTECS system as a function of time for the exemplary structural composite of iron-based metallic glass alloy and tungsten. The temperature schedule is superimposed on the graph for reference.

The HIP schedule used for this experiment is illustrated in FIG. 19 where pressure and temperature measurements taken during the HIP run are shown. The corresponding HIP canister diameter change measured by HiTECS is illustrated in FIG. 20. The HIP temperature is initially increased a temperature and held there well below the crystallization temperature, 100° C. in this case. Then, the pressure is increased and held at its maximum value, in this case 193 MPa (28 ksi). Subsequently, the temperature is increased to 1,160° C. and densification is monitored.

The measurements reveal that densification of this structural composite occurs, in essence, independently for each of the two component phases. That is, the overall consolidation curve shown in FIG. 20 is a superposition of the individual densification curves of each component. Continued densification of the iron-based powder component occurs throughout the entire temperature range up to 600° C. Further densification occurs as the temperature is ramped up to its maximum value. Above 600° C., a more gradual consolidation occurs as the temperature increases. This corresponds to the tungsten powder, as it starts to densify. Most of the densification occurs up to 1,000° C. Once the temperature increases to 1,160° C., the iron-based powder exceeds its liquidus, wherein it becomes a liquid. The densification then stops, as signified by no further change in diameter.

As the material is exposed to further temperature increases above the liquidus temperature, the tungsten powder reacts with the iron-based MGA powder to form a third interlayer phase. Depending on the chemistry of the MGA and that of tungsten, this new phase may or may not be compatible with each of the primary phases. In the case of hafnium and tungsten (refer to Example 3), the intermetallic compound that forms has a lower specific volume, which causes a reversal or expansion of the composite. In contrast, for the case of the iron, though there is a reversal as well, the intermetallic formation is not necessarily undesirable. That is, exposure of the composite material to this high temperature or continued increase in temperature allows further development of the third phase along the interface between the tungsten powder and the iron-based powder.

Figure 21:
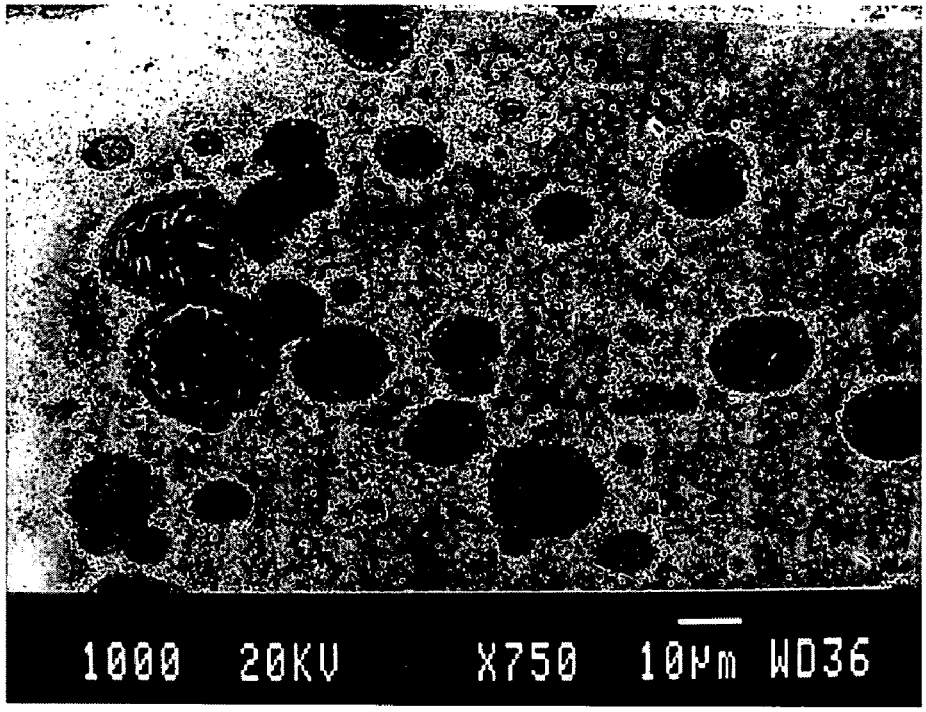
FIG. 21. Scanning electron micrograph of the resultant material substructure showing the exemplary structural composite of iron-based metallic glass alloy and tungsten. Dark regions correspond to the iron-based metallic glass alloy and light gray regions correspond to tungsten. The wide interfacial layer around the iron-based metallic glass alloy particles provides good interfacial bonding.

Near-full densification was reached for this composite material. The bulk material density was measured as 16.7 g/cm$^3$, or 98.7% of the theoretical density for this structural composite material. Scanning electron microscopy of the resultant composite material shown in FIG. 21 reveals the third crystalline phase which developed along the iron-based powder-tungsten interface as a result of exposure of the material to high temperature.

Figure 22:
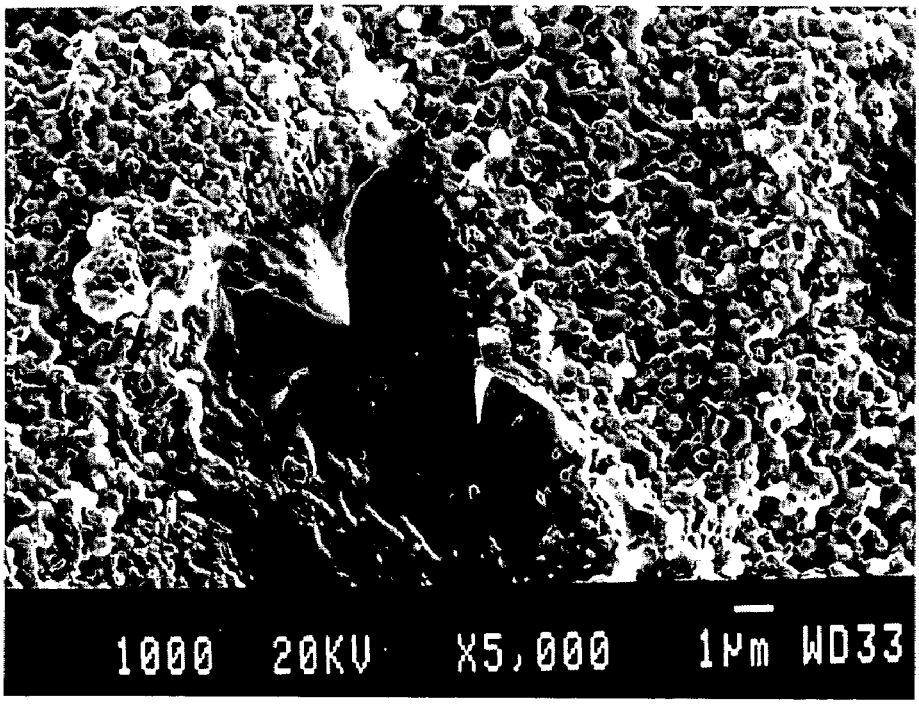
FIG. 22. Scanning electron fractograph of the resultant material substructure showing the exemplary structural composite of iron-based metallic glass alloy and tungsten. Dark regions correspond to the iron-based metallic glass alloy and light gray regions correspond to tungsten. The wide interfacial layer around the iron-based metallic glass alloy particles provide good bonding as demonstrated by the presence of transgranular fracture striations.

Due to the presence of this third phase, wetting and bonding between the two phases is excellent as demonstrated by the scanning electron fractograph shown in FIG. 22. The failure surface of the tungsten phase appears to be partially trans- to intergranular. However, the MGA phase appears to be stronger, better bonded, exhibiting brittle, transgranular fracture, as evidenced by the striations on the fracture surface.

The above examples are merely exemplary of the scope of this invention and content of this disclosure. One skilled in the art can devise and construct numerous modifications to the examples listed without departing from the scope of this invention. Furthermore, all documents and information sources cited throughout the disclosure can be used and relied upon to make and use additional aspects and specific embodiments of the invention and are specifically incorporated herein by reference for those purposes. However, no reference to a term or phrase in the cited references should be taken as a new definition, or replacement definition, of any term or phrase defined in this disclosure.

We claim:

1. A method of forming a metallic glass composite of 10 to 50 vol % metallic glass alloy and 50 to 90 vol % refractory metal, wherein the metallic glass alloy is Hf-based, the refractory metal is tungsten and the structural composite has a density range of about 16.0-18.5 g/cm$^3$, and a desired shape and size comprising:

heating a mixture of metallic glass alloy powder and refractory metal powder in a closed chamber for a period of time, wherein the metallic glass alloy powder comprises 10 to 50 vol % of the mixture and refractory metal powder comprises 50 to 90 vol % of the mixture, and wherein the temperature inside the chamber is a first temperature less than the glass transition temperature ($T_g$) of the metallic glass alloy powder, and wherein the period of time, the temperature, and the pressure inside the chamber selected promote consolidation;

further heating and pressing said mixture to a second temperature for a second period of time, wherein the second temperature is greater than the single crystallization event temperature ($T_x$) of the metallic glass alloy powder and less than about 50° C. above the liquidus temperature of the metallic glass alloy powder, and wherein the pressing of said mixture forms a desired shape and size; and immediately cooling said mixture once the second temperature is reached to obtain a metallic glass composite, whereby the formation of a third phase along the metallic glass alloy/refractory metal interface is controlled.

2. The method of claim 1, further comprising monitoring the pressing with an eddy current sensor.

3. The method of claim 2, wherein the metallic glass alloy powder comprises a Hf-based metallic glass alloy powder and the refractory metal powder comprises tungsten powder.

4. The method of claim 3, wherein the desired temperature is about 1010° C.

5. The method of claim 4, wherein the desired shape is cylindrical.

6. The method of claim 4, wherein the desired shape is cylindrical and possesses an average diameter of greater than 20 mm.

7. The method of claim 4, wherein the desired shape is cylindrical and possesses an average diameter of greater than 30 mm.

8. The method of claim 4, wherein the desired shape is cylindrical and possesses an average diameter of greater than 50 mm.

9. The method of claim 2, wherein the metallic glass powder has composition of $Hf_{44.5}Ti_5Cu_{27}Ni_{13.5}Al_{10}$.

10. The method of claim 9, wherein the desired temperature is about 1010° C.

11. The method of claim 1, wherein the metallic glass alloy powder comprises a Hf-based metallic glass alloy powder and the refractory metal powder comprises tungsten powder.

12. The method of claim 11 wherein the desired temperature is about 1010° C.

13. The method of claim 12, wherein the desired shape is cylindrical.

14. The method of claim 12, wherein the desired shape is cylindrical and possesses an average diameter of greater than 20 mm.

15. The method of claim 12, wherein the desired shape is cylindrical and possesses an average diameter of greater than 30 mm.

16. The method of claim 12, wherein the desired shape is cylindrical and possesses an average diameter of greater than 50 mm.

17. The method of claim 1, wherein the metallic glass powder has composition of $Hf_{44.5}Ti_5Cu_{27}Ni_{13.5}Al_{10}$.

18. The method of claim 17, wherein the desired temperature is about 1010° C.

19. A bulk metallic glass structural composite, comprising 10 to 50 vol % metallic glass alloy and 50 to 90 vol % refractory metal, wherein the metallic glass alloy is Hf-based, the refractory metal is tungsten and the structural composite has a density range of about 16.0-18.5 g/cm$^3$.

20. The structural composite of claim 19, wherein the shape of the material is cylindrical.

21. The structural composite of claim 19, wherein the shape of the material is cylindrical and possesses an average diameter of greater than 20 mm.

22. The structural composite of claim 19, wherein the shape of the material is cylindrical and possesses an average diameter of greater than 30 mm.

23. The structural composite of claim 19, wherein the shape of the material is cylindrical and possesses an average diameter of greater than 50 mm.

24. The structural composite of claim 19, wherein the metallic glass alloy vol % and the refractory metal vol % are selected to produce a composite having a density of about 16.0 g/cm$^3$ to about 16.9 g/cm$^3$.

25. The structural composite of claim 19, wherein the metallic glass alloy vol % and the refractory metal vol % are selected to produce a composite having a density of about 16.9 g/cm$^3$ to about 17.2 g/cm$^3$.

26. The structural composite of claim 19, wherein the metallic glass alloy vol % and the refractory metal vol % are selected to produce a composite having a density of about 17.2 g/cm$^3$ to about 17.9 g/cm$^3$.

27. The structural composite of claim 19, wherein the metallic glass alloy vol % and the refractory metal vol % are selected to produce a composite having a density of about 17.9 g/cm$^3$ to about 18.5 g/cm$^3$.

28. The structural composite of claim 19, wherein the metallic glass alloy has the composition of $Hf_{44.5}Ti_5Cu_{27}Ni_{13.5}Al_{10}$.

29. The metallic glass structural composite of claim 19, wherein the tungsten and amorphous metal are initially present as powders and the average particle size of the tungsten powder is at least twice the average particle size of the amorphous metal powder.

30. The metallic glass structural composite of claim 19, wherein the tungsten is initially present as a powder that has a submicron average particle size.

31. The metallic glass structural composite of claim 19, wherein the tungsten is initially present as a powder that has an average particle size of about 5 μm.

32. The metallic glass structural composite of claim 19, wherein the tungsten is initially present as a powder that has an average particle size of about 10 to 15 μm.

33. The metallic glass structural composite of claim 19, wherein the tungsten is initially present as a powder that has an average particle size of about 15 to 50 μm.

34. The metallic glass structural composite of claim 19, wherein the MGA is a powder that has a submicron average particle size.

35. The metallic glass structural composite of claim 19, wherein the MGA is initially present as a powder that has an average particle size of about 5 μm.

36. The metallic glass structural composite of claim 19, wherein the MGA is initially present as a powder that has an average particle size of about 5 to 15 μm.

37. The metallic glass structural composite of claim 19, wherein the MGA is initially present as a powder that has an average particle size of about 25 to 45 μm.

38. The structural composite of claim 19, wherein the metallic glass alloy further comprises molybdenum.

39. The structural composite of claim 19, wherein the metallic glass alloy further comprises tantalum.

40. The structural composite of claim 19, wherein the metallic glass alloy further comprises niobium.

41. The structural composite of claim 19, wherein the metallic glass alloy further comprises chromium.

42. The structural composite of claim 19, wherein the metallic glass alloy further comprises rhenium.

* * * * *